US011365040B2

(12) United States Patent
Okude et al.

(10) Patent No.: US 11,365,040 B2
(45) Date of Patent: Jun. 21, 2022

(54) REFILLABLE CONTAINER

(71) Applicant: NIPPON PAPER INDUSTRIES CO., LTD., Tokyo (JP)

(72) Inventors: Hideki Okude, Tokyo (JP); Takaharu Noda, Tokyo (JP)

(73) Assignee: NIPPON PAPER INDUSTRIES CO., LTD., Tokyo (JP)

( * ) Notice: Subject to any disclaimer, the term of this patent is extended or adjusted under 35 U.S.C. 154(b) by 48 days.

(21) Appl. No.: 16/959,246

(22) PCT Filed: Jan. 16, 2019

(86) PCT No.: PCT/JP2019/001051

§ 371 (c)(1),
(2) Date: Jun. 30, 2020

(87) PCT Pub. No.: WO2019/142813

PCT Pub. Date: Jul. 25, 2019

(65) Prior Publication Data

US 2020/0331682 A1 Oct. 22, 2020

(30) Foreign Application Priority Data

Jan. 17, 2018 (JP) ..... JP2018-005525
Aug. 10, 2018 (JP) ..... JP2018-151381

(51) Int. Cl.
*B65D 77/04* (2006.01)
*A47K 5/12* (2006.01)
(Continued)

(52) U.S. Cl.
CPC ..... *B65D 77/0453* (2013.01); *A47K 5/1205* (2013.01); *B65D 5/068* (2013.01);
(Continued)

(58) Field of Classification Search
CPC ..... B05B 11/0054; B05B 11/0038; B05B 11/00412; B05B 15/30; B65D 77/0453;
(Continued)

(56) References Cited

U.S. PATENT DOCUMENTS 5,878,917 A 3/1999 Reinhard et al.
8,757,440 B2 * 6/2014 Ouillette ..... B65D 77/067 222/105

(Continued)

FOREIGN PATENT DOCUMENTS

JP 7-38173 11/1993
JP 3004181 11/1994

(Continued)

OTHER PUBLICATIONS

International Search Report dated Apr. 9, 2019 in International (PCT) Application No. PCT/JP2019/001051.

*Primary Examiner* — Lien M Ngo
(74) *Attorney, Agent, or Firm* — Wenderoth, Lind & Ponack, L.L.P.

(57) ABSTRACT

A refillable container includes: an inner container having a suction port at a center of an upper surface portion and a bottom portion with a pyramid shape having a deepest portion at a center of the bottom portion; a support member configured to hold the bottom portion of the inner container to support the inner container in a standing state; a lid member fitted to an outer periphery of the inner container; a discharge pump on a top surface portion of the lid member, the discharge pump including a suction tube inserted through the suction port into the inner container; and a positioning device for positioning the inner container in a vertical direction such that a distal end of the suction tube is located in the pyramid shape of the bottom portion of the inner container.

18 Claims, 20 Drawing Sheets

(51) Int. Cl.

| | |
|---|---|
| ***B65D 5/06*** | (2006.01) |
| ***B65D 5/40*** | (2006.01) |
| ***B65D 5/72*** | (2006.01) |
| ***B65D 25/42*** | (2006.01) |
| ***B65D 47/36*** | (2006.01) |

(52) U.S. Cl.
CPC ..... *B65D 5/40* (2013.01); *B65D 5/72* (2013.01); *B65D 25/42* (2013.01); *B65D 47/36* (2013.01)

(58) Field of Classification Search
CPC . B65D 5/068; B65D 5/40; B65D 5/72; B65D 5/065; B65D 5/067; B65D 5/708; B65D 47/36; B65D 25/52; A47K 5/1205
USPC ..... 222/178, 628, 383.1, 105, 173
See application file for complete search history.

(56) References Cited

U.S. PATENT DOCUMENTS

| | | | | |
|---|---|---|---|---|
| 10,376,910 | B2 * | 8/2019 | Okude | B05B 11/0008 |
| 10,954,022 | B2 * | 3/2021 | Hatakeyama | B65D 77/06 |
| 2017/0165694 | A1 * | 6/2017 | Okude | B05B 11/0054 |
| 2018/0361412 | A1 | 12/2018 | Okude et al. | |
| 2020/0017272 | A1 * | 1/2020 | Okude | B05B 11/0054 |

FOREIGN PATENT DOCUMENTS

| | | | |
|---|---|---|---|
| JP | 07-330003 | | 12/1995 |
| JP | 09-28804 | | 2/1997 |
| JP | 10-147335 | | 6/1998 |
| JP | 2003-002328 | | 1/2003 |
| JP | 2003-205965 | | 7/2003 |
| JP | 2007-302316 | | 11/2007 |
| JP | 2019-55804 | A * | 4/2019 |
| WO | 2016/002179 | | 1/2016 |
| WO | 2017/098745 | | 6/2017 |

* cited by examiner

REFILLABLE CONTAINER

TECHNICAL FIELD

The present invention relates to a refillable container which can be refilled with a liquid such as cosmetics and detergents.

BACKGROUND ART

As a refillable container which can be refilled with a liquid such as cosmetics and detergents (including a fluid having viscosity), there has been known a refillable container including: a liquid inner container, which has a suction port formed in an upper surface, is configured to contain a liquid, and is to be replaced when the liquid has been exhausted; a support member configured to hold a bottom portion of the liquid inner container to support the liquid inner container in a standing state; a lid member which is to be fitted from above to an outer periphery of the liquid inner container supported by the support member to accommodate the liquid inner container; and a discharge pump configured to discharge the liquid to an outside by sucking the liquid through a suction tube that is inserted, and through a through hole formed in a top surface portion of the lid member, into the liquid inner container through the suction port of the liquid inner container supported by the support member (see, for example, JP 07-330003 A and JP 07-38173 Y2).

With regard to the refillable container, it is desired that the liquid be completely sucked out from the liquid inner container. However, with regard to the refillable containers described in JP 07-330003 A and JP 07-38173 Y2, such point is not taken into consideration. In order to completely suck out the liquid from the liquid inner container, it is conceivable to collect the liquid contained in the liquid inner container to one location at the bottom portion and position a distal end of the suction tube of the discharge pump to that location.

As a shape of such bottom portion, it is conceivable to form the bottom portion into a pyramid shape having a deepest portion at a center of the bottom portion. With the liquid inner container including the bottom portion formed into the pyramid shape having the deepest portion at the center of the bottom portion, the liquid can be collected to the deepest portion of the bottom portion. Through positioning of the distal end of the suction tube of the discharge pump to that location, the liquid that remains inside the liquid inner container after the discharge can be minimized in amount.

As such a container which is capable of collecting the liquid to the deepest portion of the liquid inner container at the bottom portion and positioning the distal end of the suction tube of the discharge pump to that location, there has been disclosed a pump-discharge liquid paper container having the following configuration. Specifically, the container has a shape formed of a head portion, a body having a prism shape, and a bottom portion having a reversed gable-roof shape, and a discharge pump is fixed to the head portion through insertion of a nozzle from a punched hole, which is formed in the head portion, into the container (see, for example, JP 10-147335 A).

In the pump-discharge liquid paper container described in JP 10-147335 A, the nozzle of the discharge pump is made of a material having flexibility, and a length of the nozzle is set to such a length that, when the discharge pump is fixed to the head portion of the container, a distal end of the nozzle is brought into abutment against the bottom portion having the reversed gable-roof shape to cause deflection of a distal end portion of the nozzle.

SUMMARY OF INVENTION

Technical Problem

In the pump-discharge liquid paper container described in JP 10-147335 A, the bottom portion of the container has the reversed gable-roof shape, and a length of the nozzle is set to such a length that, when the discharge pump is fixed to the head portion of the container, the distal end of the nozzle is brought into abutment against the bottom portion having the reversed gable-roof shape to cause deflection of the distal end portion of the nozzle. Therefore, a state of deflection of the distal end portion varies depending on a position at which the distal end of the nozzle is brought into abutment against the bottom portion having the reversed gable-roof shape. As a result, a position of the suction port opened at the distal end of the nozzle also varies, and hence the liquid may remain in the liquid inner container by an amount more than expected after the discharge of the liquid by the discharge pump.

Further, the discharge pump is repeatedly used for containers having been replaced every time the liquid is exhausted. The repeated use of the discharge pump may cause distinctive deflection at the distal end portion of the nozzle, and the suction port opened at the distal end of the nozzle is separated apart from the bottom portion of the container. As a result, the liquid may remain in the container by an amount more than expected after the discharge of the liquid by the discharge pump.

Further, the nozzle of the discharge pump is made of a flexible material. Therefore, the nozzle cannot be used for a container in which the punched hole formed in the head portion is sealed with a film and which is used by sticking the distal end portion of the nozzle to break the film and inserting the nozzle into the container.

An object of the present invention is to provide a refillable container which enables a distal end of a discharge pump inserted into a liquid inner container to be easily and reliably positioned to minimize an amount of a liquid that remains inside a liquid inner container after discharge.

Solution to Problem

In order to achieve the above-mentioned object, according to the invention described in a first aspect, there is provided a refillable container, including: a liquid inner container, which has a suction port formed at a center of an upper surface and a bottom portion formed into a pyramid shape having a deepest portion at a center of the bottom portion, and is configured to contain a liquid inside and be replaced when the liquid has been exhausted; a support member configured to hold the bottom portion of the liquid inner container to support the liquid inner container in a standing state; a lid member, which is fitted from above to an outer periphery of the liquid inner container supported by the support member to accommodate the liquid inner container, and has a distal end portion configured to be locked to the support member; a discharge pump, which is provided on a top surface portion of the lid member, and is configured to discharge the liquid to an outside by sucking the liquid through a suction tube that is inserted, and through the suction port of the liquid container supported by the support member, into the liquid inner container, the suction tube of the discharge pump being inserted into the suction port of the liquid inner container when the lid member is fitted from above to the outer periphery of the liquid inner container; and positioning means for positioning, at a position at which the distal end portion of the lid member fitted to the outer periphery of the liquid inner container supported by the support member is locked to the support member, a position of the liquid inner container supported by the support member in a vertical direction is determined such that a distal end of the suction tube of the discharge pump inserted through the suction port of the liquid inner container is located in the pyramid shape of the bottom portion of the liquid inner container.

According to the invention described in the first aspect, there is provided the positioning means for positioning, at the position at which the distal end portion of the lid member fitted to the outer periphery of the liquid inner container supported by the support member is locked to the support member, the position of the liquid inner container supported by the support member in the vertical direction such that the distal end of the suction tube of the discharge pump inserted through the suction port of the liquid inner container is located in the pyramid shape of the bottom portion of the liquid inner container. Therefore, when the lid member is fitted to the outer periphery of the liquid inner container supported by the support member, and the distal end portion of the lid member is locked to the support member, along with the fitting of the lid member to the outer periphery of the liquid inner container, the distal end of the suction tube of the discharge pump inserted, through the suction port of the liquid inner container supported by the support member, into the liquid inner container advances toward the deepest portion of the bottom portion, and is positioned by the positioning means, which is provided inside the support member, so as to be located in the pyramid shape of the bottom portion of the liquid inner container.

With this, the liquid having been sucked out and reduced in amount by the discharge pump and then collected into the pyramid shape of the bottom portion of the liquid inner container is sucked through the distal end of the suction tube of the discharge pump located in the pyramid shape of the bottom portion and is discharged. Accordingly, the liquid that remains inside the liquid inner container after the discharge can be minimized in amount.

According to the invention described in a second aspect, in the invention described in the first aspect, the support member includes: a support frame portion configured to accommodate the bottom portion of the liquid inner container to support the liquid inner container in the vertical direction; and a pedestal, which is provided in the support frame portion so as to protrude from an inner wall of the support frame portion toward a center, and is configured to bring an outer peripheral edge of the bottom portion of the liquid inner container accommodated in the support frame portion into abutment against an upper surface of the pedestal. The support frame portion has an upper end portion which is configured to be locked to the distal end portion of the lid member fitted to the outer periphery of the liquid inner container supported by the support frame portion. The distal end portion of the lid member, the upper end portion of the support frame portion, and the upper surface of the pedestal form the positioning means.

According to the invention described in the second aspect, through a simple operation of accommodating the bottom portion of the liquid inner container in the support frame portion, bringing the outer peripheral edge of the bottom portion of the liquid inner container into abutment against the pedestal provided in the support frame portion, fitting the lid member to the outer periphery of the liquid inner container accommodated in the support frame portion, and locking the distal end portion of the lid member to the upper end portion of the support frame portion, the position of the liquid inner container in the vertical direction can be determined such that the distal end of the suction tube of the discharge pump inserted through the suction port of the liquid inner container is located in the pyramid shape of the bottom portion of the liquid inner container.

According to the invention described in a third aspect, in the invention described in the first aspect, the support member includes: a support frame portion configured to accommodate the bottom portion of the liquid inner container to support the liquid inner container in the vertical direction; and a pedestal, which is provided in the support frame portion so as to protrude from an inner wall of the support frame portion toward a center, and is configured to bring an outer peripheral edge of the bottom portion of the liquid inner container accommodated in the support frame portion into abutment against an upper surface thereof. The lid member is configured to fit, together with the liquid inner container, to an outer periphery of the support frame portion supporting the liquid inner container. The support frame portion has, on an outer surface side thereof, a locking step portion configured to lock the distal end portion of the lid member. The distal end portion of the lid member, the locking step portion of the support frame portion, and the upper surface of the pedestal form the positioning means.

According to the invention described in the third aspect, through a simple operation of accommodating the bottom portion of the liquid inner container in the support frame portion, bringing the outer peripheral edge of the bottom portion of the liquid inner container into abutment against the pedestal provided in the support frame portion, fitting the lid member to the outer periphery of the liquid inner container accommodated in the support frame portion, further fitting the lid member to the outer periphery of the support frame portion, and locking the distal end portion of the lid member to the locking step portion formed on the outer surface side of the support frame portion, the position of the liquid inner container in the vertical direction can be determined such that the distal end of the suction tube of the discharge pump inserted through the suction port of the liquid inner container is located in the pyramid shape of the bottom portion of the liquid inner container.

Further, the lid member is fitted to the outer periphery of the support frame portion. Thus, the lid member and the support frame portion are integrated with each other. Accordingly, the discharge of the liquid from the liquid inner container by the discharge pump can easily be performed in a stable state.

According to the invention described in a fourth aspect, in the invention described in the first aspect, the support member includes: a support frame portion configured to accommodate the bottom portion of the liquid inner container to support the liquid inner container in the vertical direction; a pedestal, which is provided in the support frame portion so as to protrude from an inner wall of the support frame portion toward a center, and is configured to bring an outer peripheral edge of the bottom portion of the liquid inner container accommodated in the support frame portion into abutment against an upper surface of the pedestal; and a support base configured to allow the support frame portion to be provided upright on the upper surface. The lid member is made of an elastically deformable material, and is configured to fit, together with the support frame portion and the liquid inner container, to the outer periphery of the support base supporting the liquid inner container. The lid member has a protrusion formed on an inner side surface thereof on a distal end side, and the support base has a recess formed in an outer side surface thereof on the distal end side of the lid member so as to allow the protrusion to be engaged therewith and removed therefrom. The protrusion formed on the inner side surface of the lid member on the distal end side and the recess formed in the outer side surface of the support base form the positioning means.

According to the invention described in the fourth aspect, through a simple operation of accommodating the bottom portion of the liquid inner container in the support frame portion, bringing the outer peripheral edge of the bottom portion of the liquid inner container into abutment against the pedestal provided in the support frame portion, fitting the lid member to the outer periphery of the liquid inner container accommodated in the support frame portion, further fitting the lid member to the outer periphery of the support base, and engaging the protrusion formed on the inner surface of the lid member on the distal end side with the recess formed in the outer side surface of the support base, the position of the liquid inner container in the vertical direction can be determined such that the distal end of the suction tube of the discharge pump inserted through the suction port of the liquid inner container is located in the pyramid shape of the bottom portion of the liquid inner container.

Further, the lid member is fitted to the outer periphery of the support base. Thus, the lid member and the support frame portion are integrated with each other. Accordingly, the discharge of the liquid from the liquid inner container by the discharge pump can easily be performed in a stable state.

According to the invention described in a fifth aspect, in the invention described in any one of the second to fourth aspects, the upper surface of the pedestal is inclined downwardly toward the center, and an inclination angle of the upper surface of the pedestal with respect to a horizontal direction is an angle which is equal to an inclination angle of the bottom portion of the liquid inner container formed into the pyramid shape or larger than the inclination angle of the bottom portion.

According to the invention described in the fifth aspect, the upper surface of the pedestal is inclined downwardly toward the center, and the inclination angle of the upper surface of the pedestal with respect to the horizontal direction is an angle which is equal to the inclination angle of the bottom portion of the liquid inner container formed into the pyramid shape or larger than the inclination angle of the bottom portion. Therefore, even when the liquid inner container is a paper container, and the weight of the liquid being contained cause deformation on the bottom surface in the expanding direction, the bottom surface is received by the upper surface of the pedestal, thereby hindering the deformation in the expanding direction. With this, deformation of the pyramid shape of the bottom portion of the liquid inner container is suppressed, thereby suppressing a change in position of the deepest portion. Accordingly, the distal end of the suction tube of the discharge pump inserted through the suction port of the liquid inner container can be reliably positioned so as to be located in the pyramid shape of the bottom portion of the liquid inner container.

According to the invention described in a sixth aspect, in the invention described in any one of the second to fifth aspects, the pedestal is formed of a plurality of pedestal pieces, which are arranged in the support frame portion in a standing state at predetermined intervals in a circumferential direction, and respective upper sides of the plurality of pedestal pieces serve as the upper surface of the pedestal.

According to the invention described in the sixth aspect, the pedestal is formed of the plurality of pedestal pieces, which are arranged in the support frame portion in the standing state at predetermined intervals in the circumferential direction, and the respective upper sides of the plurality of pedestal pieces serve as the upper surface of the pedestal. Accordingly, the pedestal having the upper surface inclined downwardly toward the center can easily be formed.

According to the invention described in a seventh aspect, in the invention described in any one of the second to sixth aspects, in the support frame portion, a height of a protruding portion protruding upwardly from the pedestal in contact with an inner wall of the support frame portion is a height which is equal to or larger than 5% of a body height of the liquid inner container and is smaller than the body height of the liquid inner container.

According to the invention described in the seventh aspect, in the support frame portion, the height of the protruding portion protruding upwardly from the pedestal in contact with the inner wall of the support frame portion is the height which is equal to or larger than 5% of the body height of the liquid inner container and is smaller than the body height of the liquid inner container.

Accordingly, the liquid inner container accommodated in the support frame portion can reliably be guided in the vertical direction and held in the vertical direction by the inner wall of the support frame portion protruding upwardly from the pedestal. Thus, the outer peripheral edge of the bottom portion of the liquid inner container accommodated in the support frame portion can reliably be brought into abutment against the pedestal provided in the support frame portion.

With this, the position of the liquid inner container in the vertical direction can easily and reliably be determined such that the distal end of the suction tube of the discharge pump inserted through the suction port of the liquid inner container is located in the pyramid shape of the bottom portion of the liquid inner container.

According to the invention described in an eighth aspect, in the invention described in the first aspect, the liquid inner container includes a skirt portion, which is provided at a lower portion of the liquid inner container main body, and is configured to cover the bottom portion formed into the pyramid shape and enable the liquid inner container to stand.

According to the invention described in the eighth aspect, the liquid inner container includes the skirt portion, which is provided at the lower portion of the liquid inner container main body, and is configured to cover the bottom portion formed into the pyramid shape and enable the liquid inner container to stand. Accordingly, when the skirt portion is brought into abutment against a placement surface, the liquid inner container is allowed to stand under a state in which the bottom portion is oriented downwardly.

With this, in a case in which only the liquid inner container is displayed for selling, the liquid inner container can be displayed in a normal state in which an upper surface side thereof is located on an upper side. Therefore, there is no need to make particular consideration with regard to orientation at the time of printing of a logo of a product or an indication of a liquid content, which is printed on a body surface of the liquid inner container.

Further, the bottom portion is covered with the skirt portion, and hence the bottom portion is not brought into abutment against the placement surface when the liquid inner container is placed on the placement surface. Accordingly, the distal end part of the bottom portion formed into the pyramid shape is less liable to be deformed.

According to the invention described in a ninth aspect, in the invention described in the eighth aspect, the skirt portion is set to such a length that, at a position at which the distal end portion of the lid member fitted to the outer periphery of the liquid inner container supported by the support member is locked to the support member, a position of the liquid inner container supported by the support member in the vertical direction is determined such that the distal end of the suction tube of the discharge pump inserted through the suction port is located in the pyramid shape of the bottom portion, thereby forming the positioning means.

According to the invention described in the ninth aspect, the skirt portion is set to such a length that, at the position at which the distal end portion of the lid member fitted to the outer periphery of the liquid inner container supported by the support member is locked to the support member, the position of the liquid inner container supported by the support member in the vertical direction is determined such that the distal end of the suction tube of the discharge pump inserted through the suction port is located in the pyramid shape of the bottom portion, thereby forming the positioning means. Accordingly, when the lid member is fitted to the outer periphery of the liquid inner container supported by the support member, and the distal end portion of the lid member is locked to the support member, along with the fitting of the lid member to the outer periphery of the liquid inner container, the distal end of the suction tube of the discharge pump inserted into the liquid inner container through the suction port of the liquid inner container supported by the support member advances toward the deepest portion of the bottom portion, and the skirt portion allows the distal end of the suction tube to be located in the pyramid shape of the bottom portion of the liquid inner container.

With this, the liquid having been sucked out and reduced in amount by the discharge pump and then collected into the pyramid shape of the bottom portion of the liquid inner container is sucked through the distal end of the suction tube of the discharge pump located in the pyramid shape of the bottom portion and is discharged. Accordingly, the liquid that remains inside the liquid inner container after the discharge can be minimized in amount.

Advantageous Effects of Invention

According to the refillable container of the present invention, at the time of discharging the liquid from the liquid inner container, which has the suction port formed at the center of the upper surface, includes the bottom portion formed into the pyramid shape having the deepest portion at the center of the bottom portion, and is configured to contain the liquid inside, the distal end of the suction tube of the discharge pump inserted into the liquid inner container can easily and reliably be positioned so as to be located in the pyramid shape of the bottom portion of the liquid inner container. Accordingly, the liquid that remains inside the liquid inner container after the discharge can be minimized in amount, thereby being capable of preventing waste of the liquid as much as possible.

DESCRIPTION OF EMBODIMENTS

Now, an example of a refillable container according to an embodiment of the present invention is described in detail with reference to the drawings.

Figure 1:
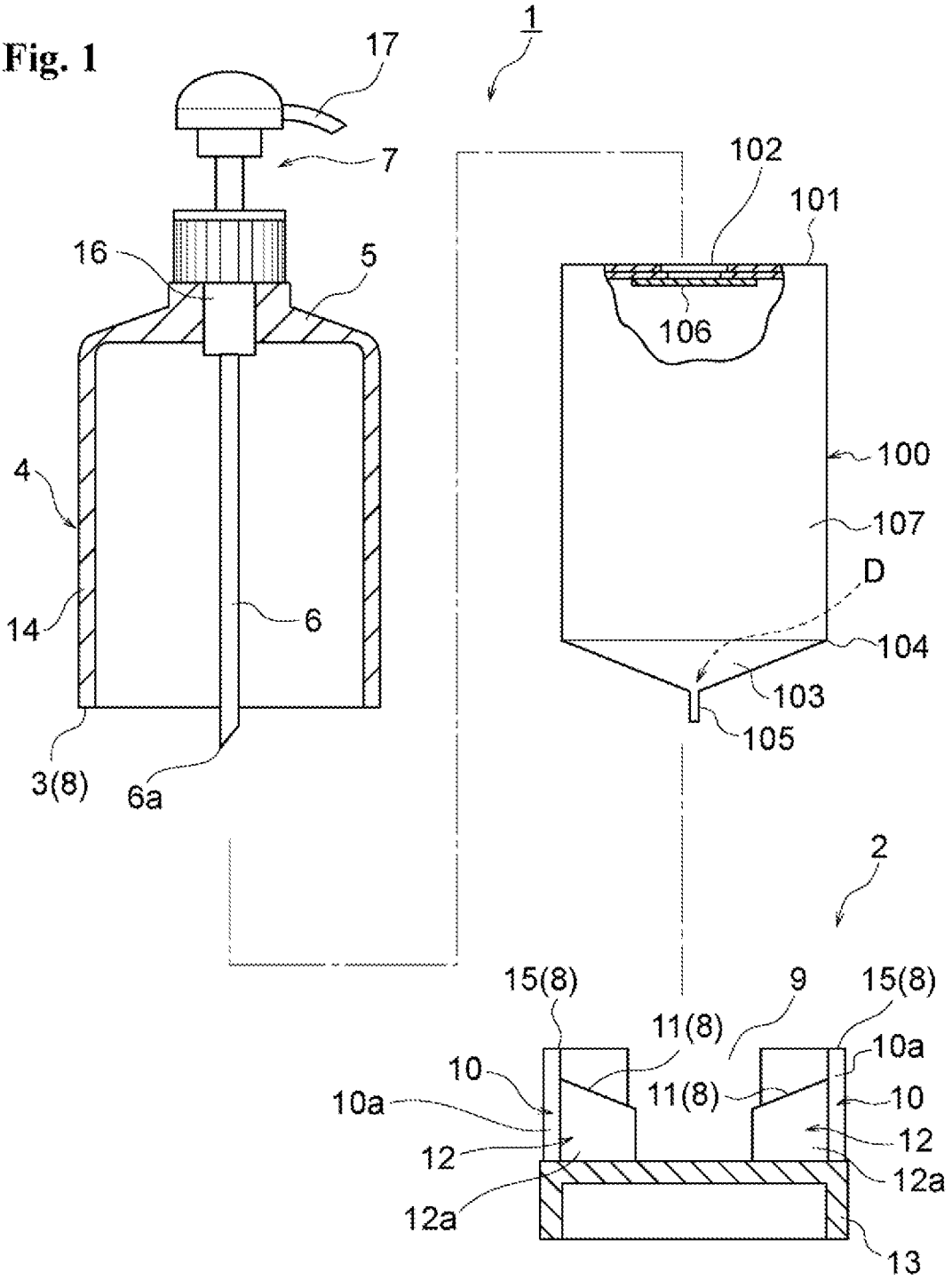
FIG. 1 is an exploded sectional view for illustrating a first example of a refillable container according to an embodiment of the present invention.
Figure 2:
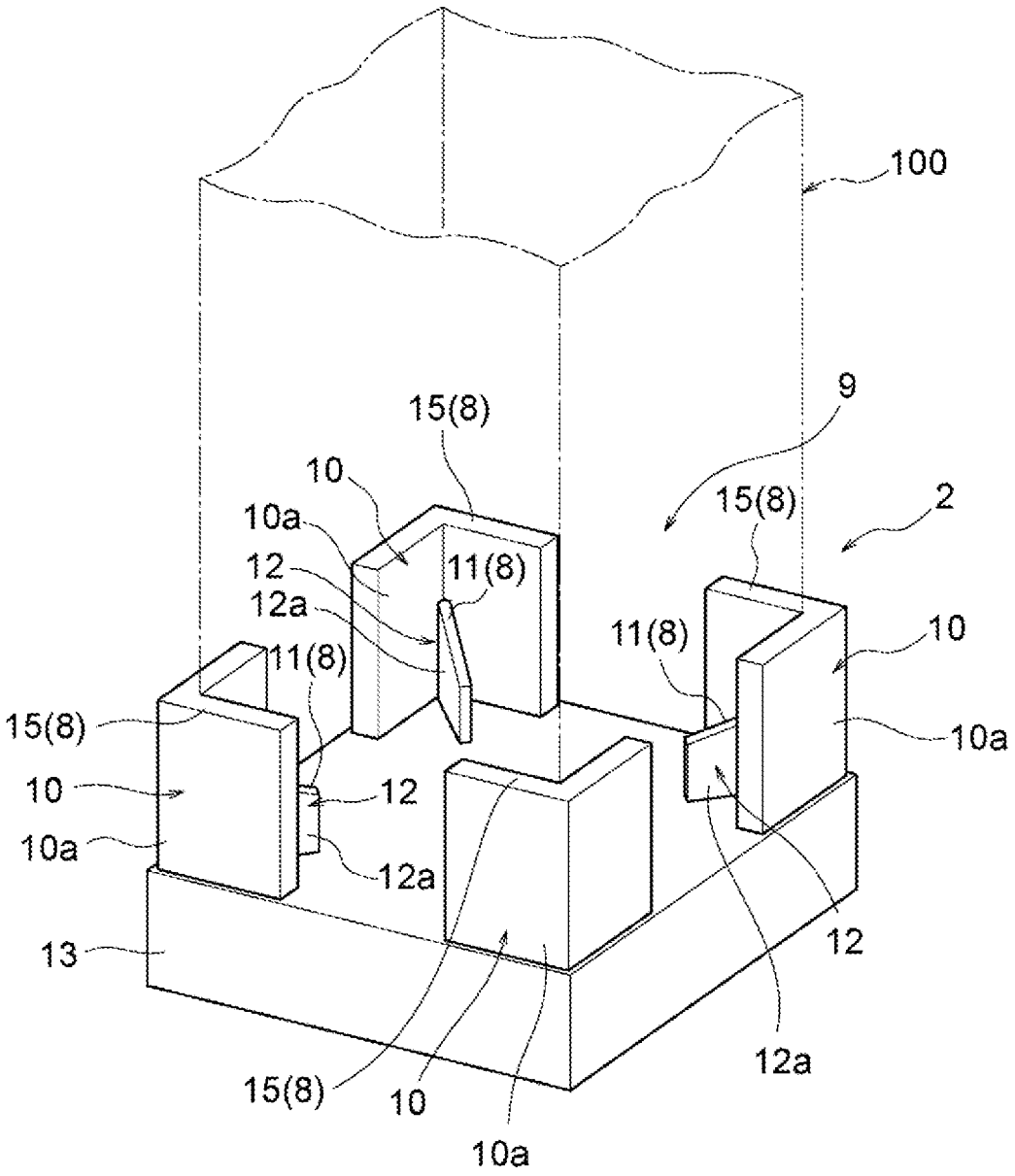
FIG. 2 is an enlarged perspective view for illustrating a support member in the refillable container illustrated in FIG. 1.
Figure 3:
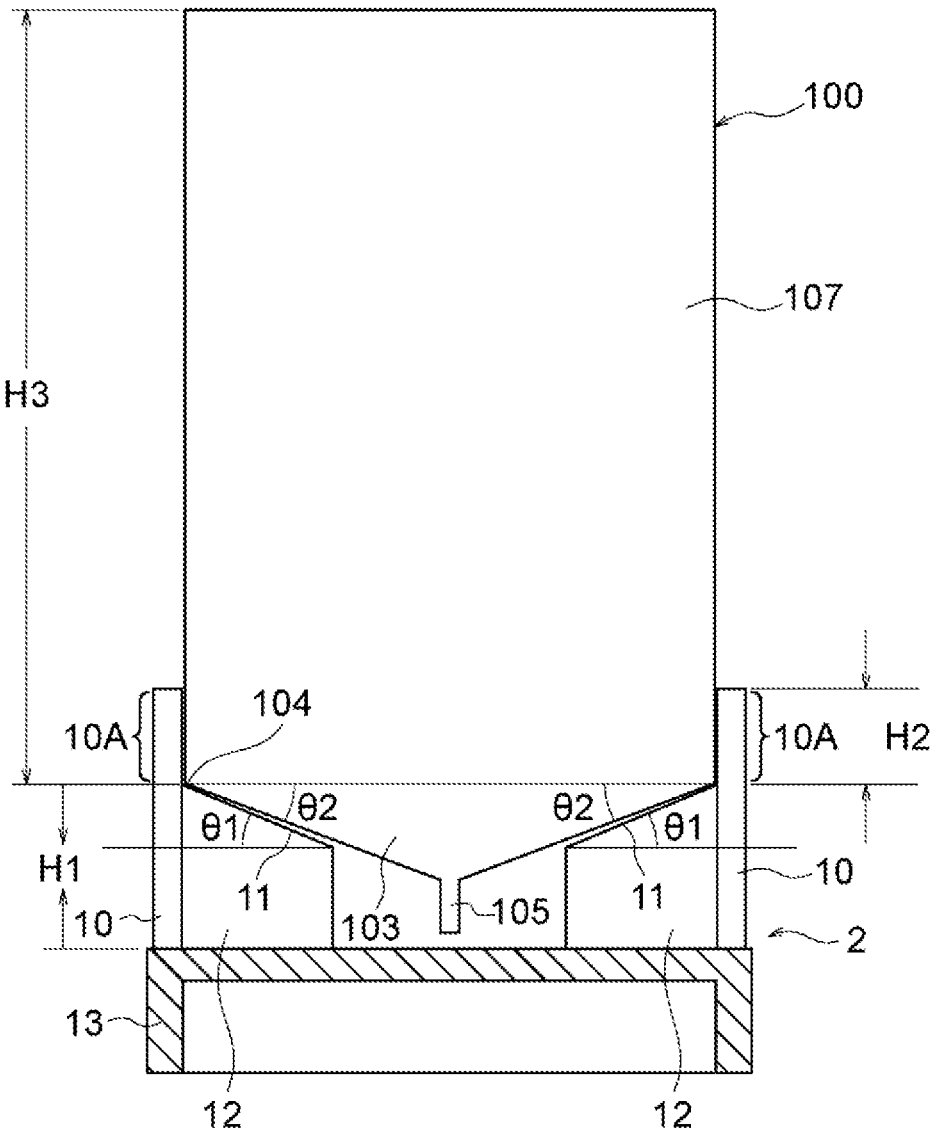
FIG. 3 is an explanatory view for illustrating a relationship between the support member in the refillable container illustrated in FIG. 1 and a liquid inner container supported by the support member.
Figure 4:
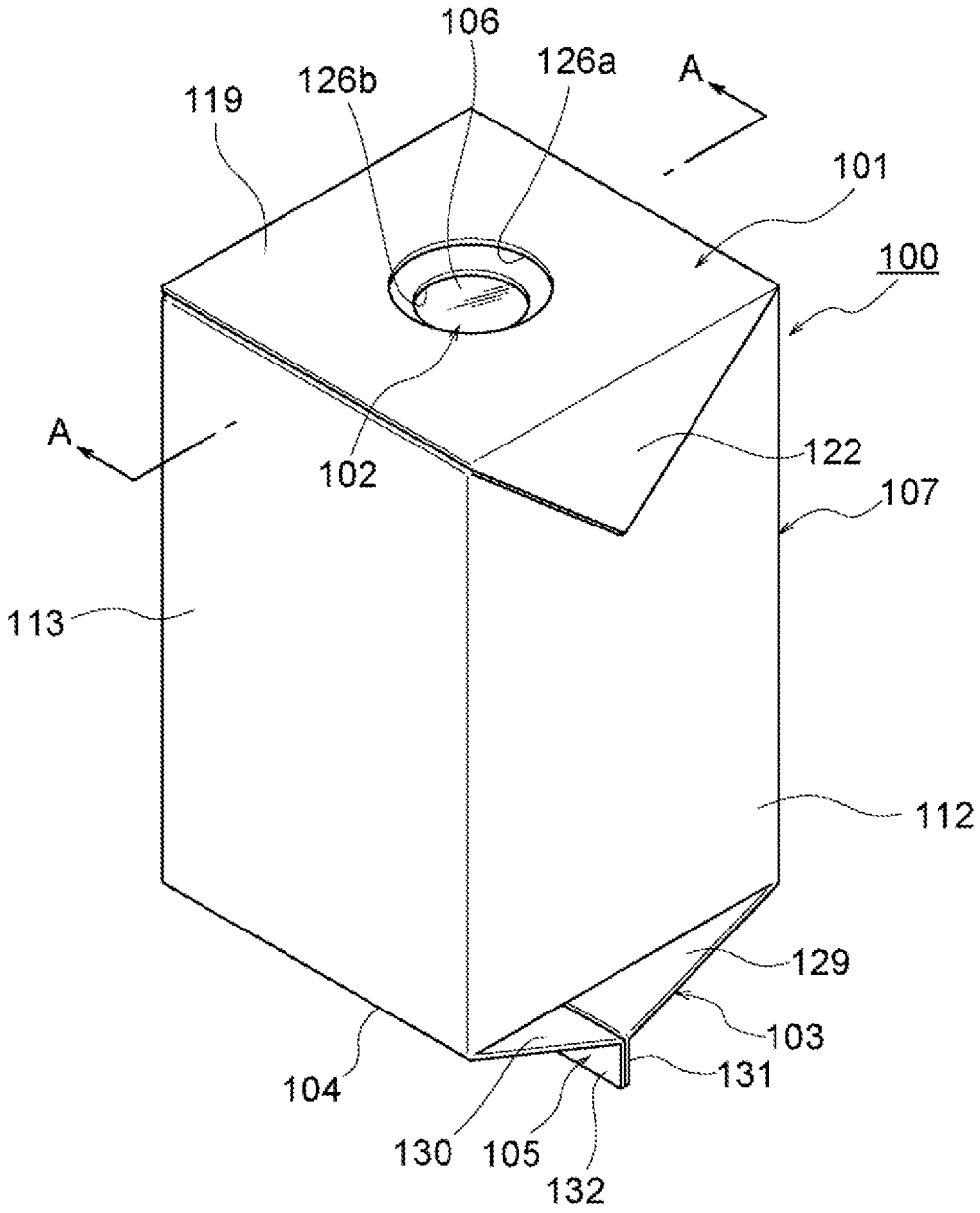
FIG. 4 is a perspective view for illustrating an example of the liquid inner container from which a liquid is discharged in the present invention.
Figure 5:
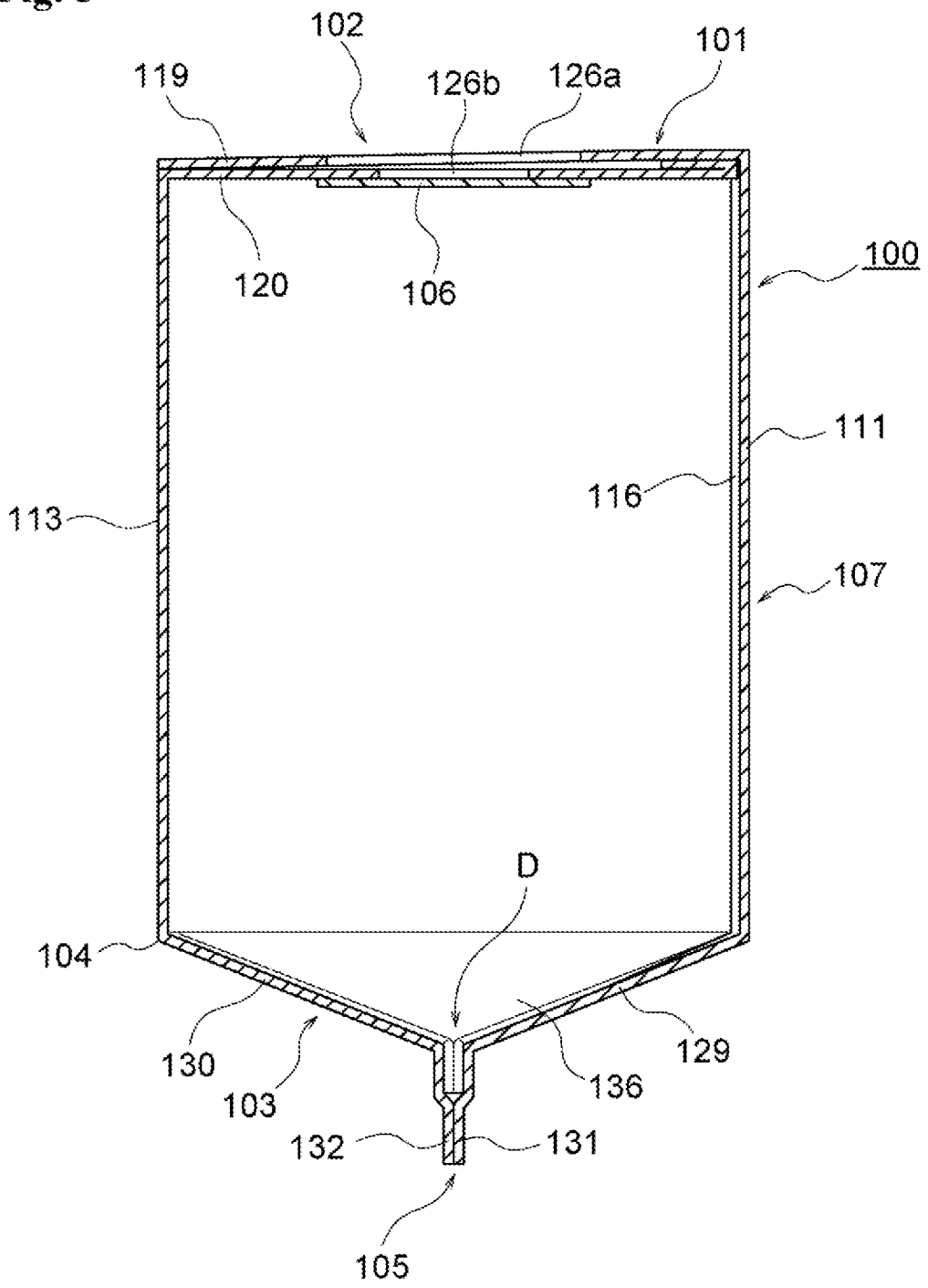
FIG. 5 is a sectional view taken along the line A-A of FIG. 4.
Figure 6:
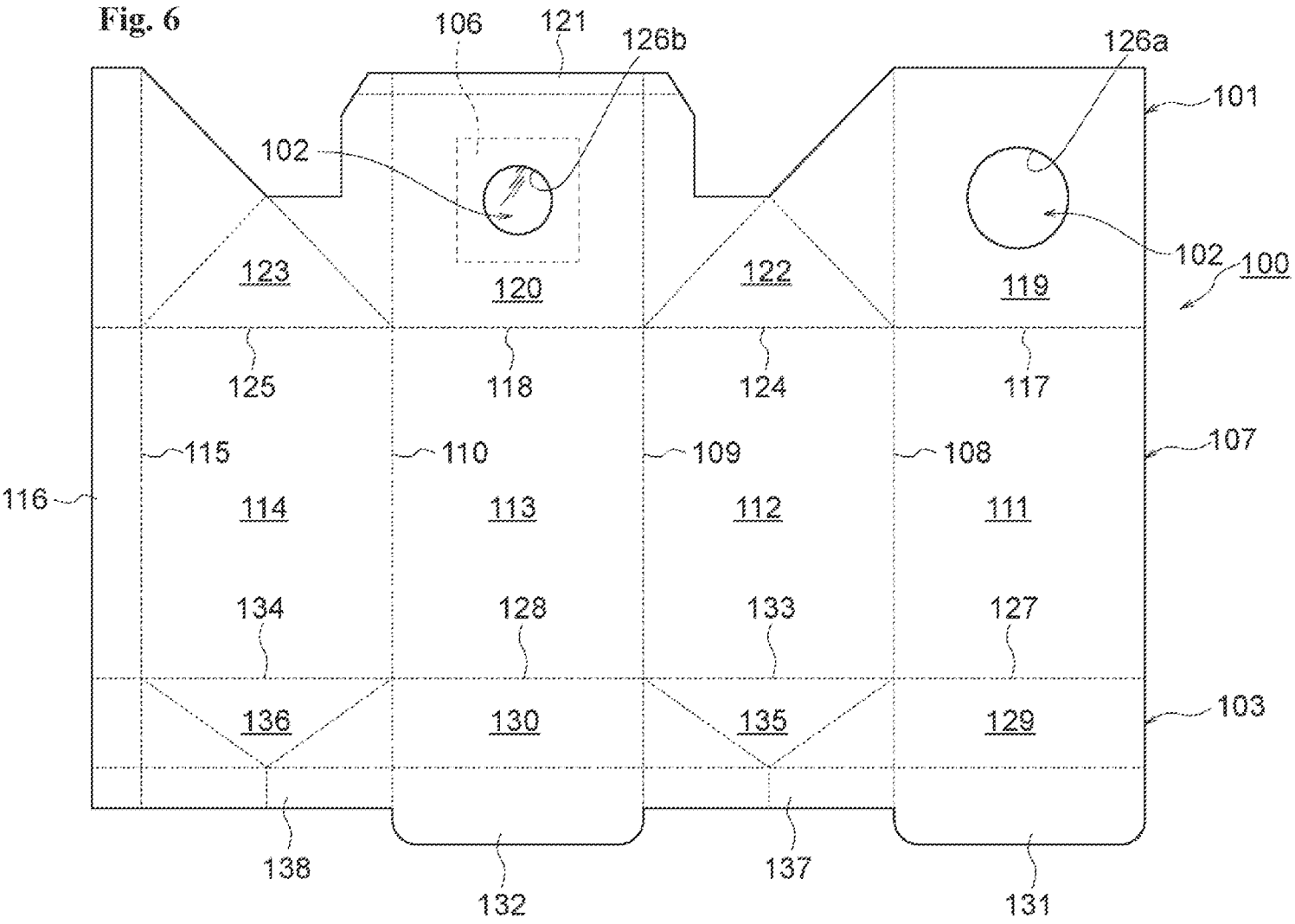
FIG. 6 is a developed view for illustrating a carton blank before an assembly process of the liquid inner container illustrated in FIG. 4.
Figure 7:
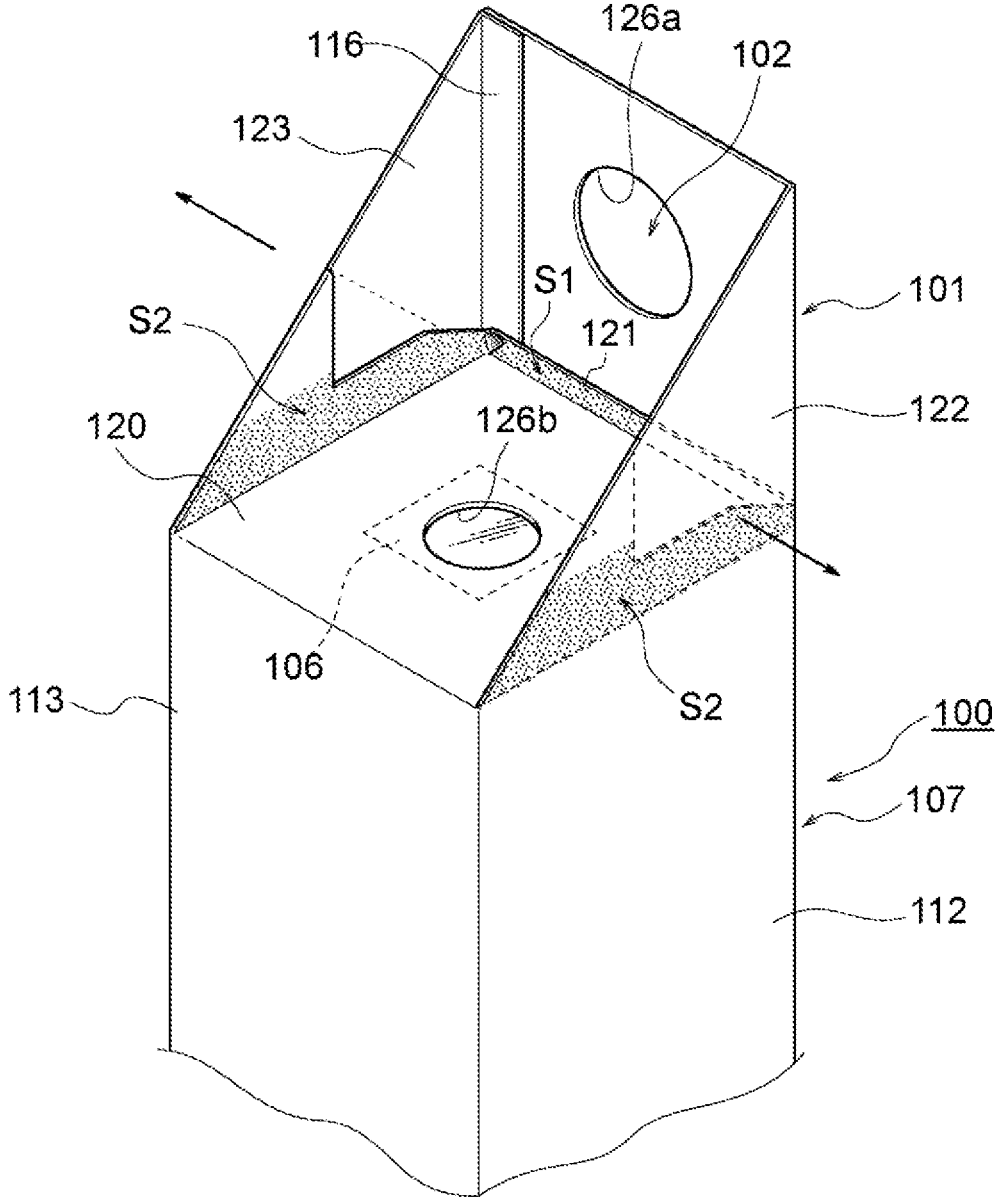
FIG. 7 is an explanatory view for illustrating a step of forming an upper surface of the liquid inner container illustrated in FIG. 4.
Figure 8:
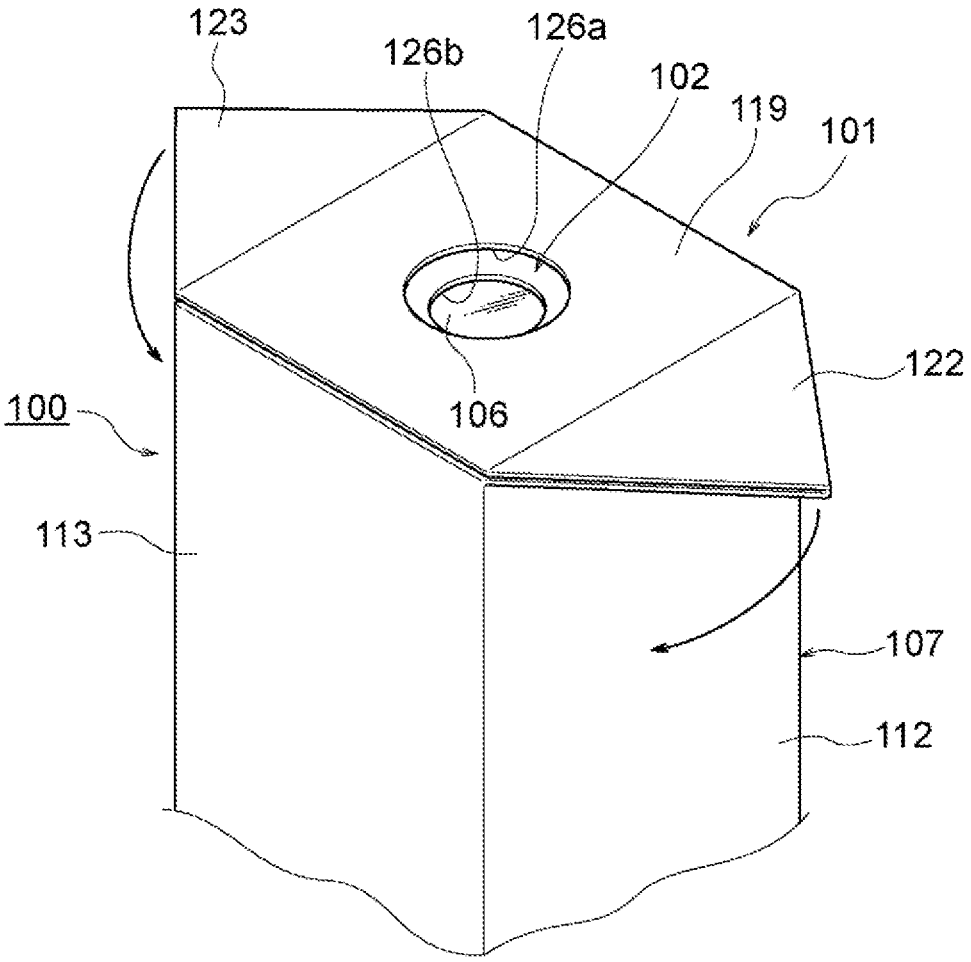
FIG. 8 is an explanatory view for illustrating a step of forming the upper surface of the liquid inner container illustrated in FIG. 4.
Figure 9:
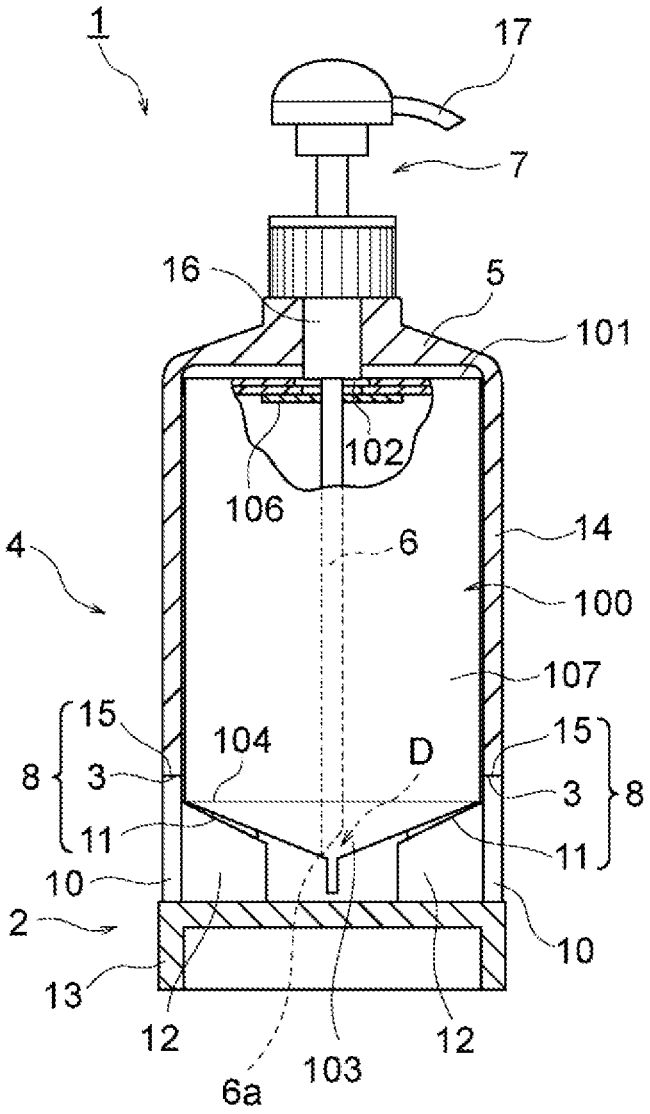
FIG. 9 is an explanatory view for illustrating a state in which a distal end portion of a lid member fitted to an outer periphery of the liquid inner container supported by the support member in the refillable container illustrated in FIG. 1 is locked to the support member.

FIG. 1 to FIG. 9 are views for illustrating a first example of the refillable container according to the embodiment of the present invention. FIG. 1 is an exploded sectional view for illustrating the first example of the refillable container. FIG. 2 is an enlarged perspective view for illustrating a support member in the refillable container illustrated in FIG. 1. FIG. 3 is an explanatory view for illustrating a relationship between the support member in the refillable container illustrated in FIG. 1 and a liquid inner container supported by the support member. FIG. 4 is a perspective view for illustrating an example of the liquid inner container from which a liquid is discharged in the present invention. FIG. 5 is a sectional view taken along the line A-A of FIG. 4. FIG. 6 is a developed view for illustrating a carton blank before an assembly process of the liquid inner container illustrated in FIG. 4. FIG. 7 is an explanatory view for illustrating a step of forming an upper surface of the liquid inner container illustrated in FIG. 4. FIG. 8 is an explanatory view for illustrating a step of forming the upper surface of the liquid inner container illustrated in FIG. 4. FIG. 9 is an explanatory view for illustrating a state in which a distal end portion of a lid member fitted to an outer periphery of the liquid inner container supported by the support member is locked to the support member in the refillable container illustrated in FIG. 1.

A refillable container 1 of the first example includes a liquid inner container 100, a support member 2, a lid member 4, and a discharge pump 7. The liquid inner container 100 has a suction port 102 formed at a center of an upper surface 101, includes a bottom portion 103 formed into a pyramid shape having a deepest portion D at a center of the bottom portion 103, and is configured to contain a liquid. The support member 2 is configured to accommodate and support the bottom portion 103 of the liquid inner container 100. The lid member 4 is fitted from above to an outer periphery of the liquid inner container 100 supported by the support member 2 to accommodate the liquid inner container 100, and has a distal end portion 3 configured to be locked to the support member 2. The discharge pump 7 is provided on a top surface portion 5 of the lid member 4, and is configured to discharge the liquid to an outside by sucking the liquid through a suction tube 6 that is inserted, and through the suction port 102 of the liquid inner container 100 supported by the support member 2, into the liquid inner container 100. The suction tube 6 of the discharge pump 7 is inserted into the suction port 102 of the liquid inner container 100 when the lid member 4 is fitted from above to the outer periphery of the liquid inner container 100.

The refillable container 1 further includes positioning means 8 for positioning, at a position at which the distal end portion 3 of the lid member 4 fitted to the outer periphery of the liquid inner container 100 supported by the support member 2 is locked to the support member 2, a position of the liquid inner container 100 accommodated in the support member 2 in a vertical direction is determined such that a distal end 6*a* of the suction tube 6 of the discharge pump 7 inserted through the suction port 102 of the liquid inner container 100 is located in the pyramid shape of the bottom portion 103 of the liquid inner container 100.

Description is made of the support member 2. A shape and a material of the support member 2 are not particularly limited as long as the support member 2 is capable of accommodating and supporting the bottom portion 103 of the liquid inner container 100 formed into the pyramid shape having the deepest portion D at the center of the bottom portion 103.

As illustrated in FIG. 2, the support member 2 of the first example includes a support frame portion 10 and a pedestal 12. The support frame portion 10 has an accommodation opening 9 at an upper portion, and is configured to accommodate the bottom portion 103 of the liquid inner container 100 to support the liquid inner container 100 in the vertical direction. The pedestal 12 is provided in the support frame portion 10 so as to protrude from an inner wall of the support frame portion 10 toward a center, and is configured to bring an outer peripheral edge 104 of the bottom portion 103 into abutment against an upper surface 11 of the pedestal 12 to support the liquid container 100 accommodated in the support frame portion 10.

The support frame portion 10 has a shape which allows the liquid inner container 100 to be accommodated in the support frame portion 10, and is formed into a shape conforming to an outer shape of the liquid inner container 100. As described later, a sectional shape of a body of the liquid inner container 100 used in the first example is a substantially square shape, and a shape of the support frame portion 10 also is a substantially square shape.

Further, the support frame portion 10 has a configuration in which a plurality of support frame pieces 10*a* are provided upright on an upper surface of a support base 13 and arranged at intervals along an outer surface of the liquid inner container 100. In the first example, the plurality of support frame pieces 10*a* are provided along respective outer surfaces of corner portions of the liquid inner container 100.

Further, the upper surface 11 of the pedestal 12 provided in the support frame portion 10 is inclined downwardly toward the center. An inclination angle θ1 of the upper surface 11 with respect to a horizontal direction is an angle which is equal to an inclination angle θ2 of the bottom portion 103 of the liquid inner container 100 formed into the pyramid shape or larger than the inclination angle θ2 of the bottom portion 103. In the first example, the inclination angle θ1 of the upper surface 11 of the pedestal 12 with respect to the horizontal direction is an angle slightly larger than the inclination angle θ2 of the bottom portion 103 of the liquid inner container 100 (see FIG. 3).

Further, the pedestal 12 provided in the support frame portion 10 formed of the support frame pieces 10*a* is formed of a plurality of pedestal pieces 12*a*. The plurality of pedestal pieces 12*a* are arranged in a standing state at predetermined intervals in a circumferential direction in the support frame portion 10, and respective upper sides of the plurality of pedestal pieces 12*a* serve as the upper surface 11 of the pedestal 12.

In the first example, respective outer vertical sides of the pedestal pieces 12*a* forming the pedestal 12 are fixed to respective inner walls of the support frame pieces 10*a* forming the support frame portion 10. A height H1 of each of the outer vertical sides of the pedestal pieces 12*a* is set to such a height that at least a seal portion 105 at a distal end of the bottom portion 103 is prevented from being brought into abutment against the support base 13 when the outer peripheral edge 104 of the bottom portion 103 of the liquid inner container 100 is brought into abutment against and supported by the upper surfaces 11 of the pedestal pieces 12*a* (see FIG. 3).

Further, with regard to the support member 2, a height H2 of a protruding portion 10A protruding upwardly from the pedestal 12 in contact with the inner wall of the support frame portion 10 is set to a height which is equal to or larger than 5% of a height H3 of a body 107 of the liquid inner container 100 and smaller than the height H3 of the body 107 of the liquid inner container 100, or a height equal to the height H3 (see FIG. 3).

Next, description is made of the lid member 4. The lid member 4 of the first example includes the top surface portion 5 and a tubular wall portion 14. The tubular wall portion 14 is fitted from above to the outer periphery of the liquid inner container 100 supported by the support member 2 to accommodate the liquid inner container 100. When the tubular wall portion 14 is fitted from above to the outer periphery of the liquid inner container 100, the distal end portion 3 is configured to be locked to an upper end portion 15 of the support frame portion 10 provided to the support member 2.

The distal end portion 3 of the tubular wall portion 14 of the lid member 4, the upper end portion 15 of the support frame portion 10 provided to the support member 2, and the upper surface 11 of the pedestal 12 form positioning means 8 for positioning a position of the liquid inner container 100 supported by the support member 2 in the vertical direction is determined such that, when the tubular wall portion 14 of the lid member 4 is fitted from above to the liquid inner container 100 supported by the support member 2, the distal end 6*a* of the suction tube 6 is located in the pyramid shape of the bottom portion 103 of the liquid inner container 100.

Next, description is made of the discharge pump 7 configured to discharge the liquid to the outside by sucking the liquid from the liquid inner container 100 supported by the support member 2.

The discharge pump 7 includes a tubular cylinder portion 16, a discharge nozzle 17, and the suction tube 6. The discharge nozzle 17 is provided at an upper portion of the tubular cylinder portion 16, and serves as an operation portion of a piston freely fitted to be slidable in the tubular cylinder portion 16. The suction tube 6 is provided at a lower portion of the tubular cylinder portion 16.

With regard to the discharge pump 7 thus configured, the tubular cylinder portion 16 penetrates the top surface portion 5 of the lid member 4 to be secured. The discharge nozzle 17 is arranged on an upper surface side of the top surface portion 5, and the suction tube 6 is arranged on a lower surface side of the top surface portion 5. When the lid member 4 is fitted from above to the outer periphery of the liquid inner container 100, the suction tube 6 of the discharge pump 7 is inserted into the suction port 102 of the liquid inner container 100.

In the liquid inner container 100 used in the first example, as described later, the suction port 102 formed at the center of the upper surface 101 is sealed with a sealing sheet 106. When the lid member 4 is fitted from above to the outer periphery of the liquid inner container 100, the suction tube 6 of the discharge pump 7 tears the sealing sheet 106 and is inserted into the liquid inner container 100 through the suction port 102.

A length of the suction tube 6 of the discharge pump 7 is set to such a length that, when the tubular wall portion 14 of the lid member 4 is fitted from above to the liquid inner container 100 supported by the support member 2 so that the distal end portion 3 of the tubular wall portion 14 forming the positioning means 8 is locked to the upper end portion 15 of the support frame portion 10 provided to the support member 2, the distal end 6*a* of the suction tube 6 is located at that position in the pyramid shape of the bottom portion 103 of the liquid inner container 100. In the first example, the length of the suction tube 6 is set to such a length that the distal end 6*a* of the suction tube 6 is located at the deepest portion D in the pyramid shape of the bottom portion 103 of the liquid inner container 100.

Next, description is made of the liquid inner container 100 used in the first example. A sectional shape of the body 107 of the liquid inner container 100 is a substantially square shape, and is shaped to be accommodated in the support member 2.

The sectional shape of the liquid inner container 100 is not limited to the substantially square shape, and may be a polygonal shape, a circular shape, or an oval shape, or any shape that enables the liquid inner container 100 to be accommodated in the support member 2 and the lid member 4.

The liquid inner container 100 is made of a paper material formed with a resin layer on at least one side thereof, has four body panels 111, 112, 113, and 114 via body longitudinal folding lines 108, 109, and 110, and includes the body 107 formed into a rectangular tubular shape in which an edge portion of the body panel 111 is joined by a longitudinal seal panel 116 which is connected consecutively to the body panel 114 via a seal longitudinal folding line 115.

The upper surface 101 of the liquid inner container 100 is configured as described below. A pair of upper-surface forming panels 119 and 120, which face each other and overlap in the vertical direction, are continuously provided on upper edges of the body panels 111 and 113 through top horizontal folding lines 117 and 118. Further, a sealing panel 121 for sealing an inner surface of the upper-surface forming panel 119 is continuously provided on an upper edge of the upper-surface forming panel 120, which underlies the upper-surface forming panel 119.

Further, a pair of side panels 122 and 123 are continuously provided on upper edges of the body panels 112 and 114 through top horizontal folding lines 124 and 125. The pair of side panels 122 and 123 are positioned between the above-mentioned pair of upper-surface forming panels 119 and 120 to face each other and folded up along with overlapping of the pair of upper-surface forming panels 119 and 120.

Further, holes 126*a* and 126*b* are formed at centers of the upper-surface forming panels 119 and 120, respectively, to serve as the suction port 102. The holes 126*a* and 126*b* are opened so that a center of the hole 126*a* and a center of the hole 126*b* match with each other when the upper-surface forming panels 119 and 120 overlap. The sealing sheet 106, which is tearable, is provided on a back surface of the upper-surface forming panel 120 so as to seal the hole 126*b*. The suction tube 6 of the discharge pump 7 is stuck into the sealing sheet 106 so as to tear the film 3.

The sealing sheet 106 may be pasted on a back surface of the upper-surface forming panels 120, or may be formed integrally with a laminated product which is laminated on the paper material formed with the resin layer forming the liquid inner container 100. Further, the sealing sheet 106 is not particularly limited to the material and the configuration described above as long as the sealing sheet 106 is impermeable and tearable. As the sealing sheet 106, a resin film, a metal foil, a sheet of paper, or a laminated body thereof is exemplified.

The upper surface 101 of the liquid inner container 100 is formed by the upper-surface forming panels 119 and 120 and the side panels 122 and 123 as described below. After the body 107 is formed, first, the upper-surface forming panel 120 is folded inwardly. Along with that, the side panels 122 and 123 are folded up to inner surface sides into a triangular shape, and an upper accommodation opening of the body 107 is closed by the upper-surface forming panel 120. Then, the sealing panel 121, which is continuously provided on the upper edge of the upper-surface forming panel 120, is bonded to the inner surface of the upper-surface forming panel 119 in an area of S1 so as to seal the liquid inner container 100. Both side edges of the upper-surface forming panel 120 are bonded to the side panels 122 and 123, which have been folded up into a triangular shape, in an area of S2 so as to seal the liquid inner container 100 (see FIG. 7).

Next, the side panels 122 and 123 are folded up outwardly (in directions indicated by the arrows of FIG. 7) so that the upper-surface forming panel 119 overlies the upper-surface forming panel 120 (see FIG. 8). The side panels 122 and 123, which have been folded up to protrude to an outside of the body 107, are folded downwardly (in directions indicated by the arrows of FIG. 8), and fixed to the body 107 with an adhesive or the like. Accordingly, the upper surface 101 is formed.

Further, in this example, the bottom portion 103 of the liquid inner container 100 is configured as described below.

A pair of gable roof-shaped bottom portion forming panels 129 and 130, which face each other, are continuously provided on lower edges of the body panels 111 and 113 through bottom horizontal folding lines 127 and 128. Outer sealing panels 131 and 132, which have a belt-like shape, are continuously provided on lower parts of the gable roof-shaped bottom portion forming panels 129 and 130.

Further, a pair of gable wall-shaped bottom portion forming panels 135 and 136, which face each other, are continuously provided on lower edges of the body panels 112 and 114 through bottom horizontal folding lines 133 and 134. Inner sealing panels 137 and 138, which have a belt-like shape and a height smaller than that of the outer sealing panels 131 and 132, are continuously provided on lower parts of the gable wall-shaped bottom portion forming panels 135 and 136.

Further, the bottom portion 103 is formed by the gable roof-shaped bottom portion forming panels 129 and 130 and the gable wall-shaped bottom portion forming panels 135 and 136 as described below. The gable wall-shaped bottom portion forming panels 135 and 136 are folded in between the gable roof-shaped bottom portion forming panels 129 and 130, and facing surfaces of the outer sealing panels 131 and 132, which face each other, are bonded to each other to seal the liquid inner container 100. Further, facing surfaces of the outer sealing panels 131 and 132 and facing surfaces of the inner sealing panels 137 and 138, and facing surfaces of the inner sealing panels 137 and 138 are bonded to each other to seal the liquid inner container 100. Accordingly, the bottom portion 103 is formed into a quadrangular pyramid shape of a so-called reversed gable-roof shape (see FIG. 4 and FIG. 5).

The discharge of the liquid from the liquid inner container 100 with use of the refillable container 1 of the first example thus configured is performed as follows.

First, the bottom portion 103 of the liquid inner container 100 containing the liquid inside thereof is accommodated in the support frame portion 10 provided to the support member 2, and the outer peripheral edge 104 of the bottom portion 103 is brought into abutment against the upper surface 11 of the pedestal 12 provided in the support frame portion 10 so that the outer peripheral edge 104 is supported.

The support frame portion 10 has such a height that the height H2 of the protruding portions 10A protruding upwardly from the pedestal 12 in contact with the inner wall of the support frame portion 10 is equal to or larger than 5% of the height H3 of the body 107 of the liquid inner container 100 and is smaller than the height H3 of the body 107 of the liquid inner container 100. Thus, the liquid inner container 100 accommodated in the support frame portion 10 is guided in the vertical direction by the inner walls of the protruding portions 10A and held in the vertical direction, and the outer peripheral edge 104 of the bottom portion 103 is reliably brought into abutment against the upper surface 11 of the pedestal 12 provided in the support frame portion 10. Accordingly, a position in the vertical direction is determined.

Further, the upper surface 11 of the pedestal 12 provided in the support frame portion 10 is inclined downwardly toward the center, and the inclination angle θ1 thereof with respect to the horizontal direction is an angle which is equal to the inclination angle θ2 of the bottom portion 103 of the liquid inner container 100 formed into the pyramid shape or larger than the inclination angle θ2 of the bottom portion 103. Thus, even when the weight of the liquid contained in the liquid inner container 100 causes deformation of the bottom surface of the bottom portion 103 in an expanding direction, the bottom surface is received by the upper surface 11 of the pedestal 12, thereby hindering the deformation in the expanding direction. With this, deformation of the pyramid shape of the bottom portion 103 of the liquid inner container 100 is suppressed, thereby suppressing a change in position of the deepest portion D.

Next, the tubular wall portion 14 of the lid member 4 is fitted from above to the outer periphery of the liquid inner container 100 supported by the support member 2. When the tubular wall portion 14 of the lid member 4 is fitted to the outer periphery of the liquid inner container 100, the suction tube 6 of the discharge pump 7 provided to the top surface portion 5 of the lid member 4 tears the sealing sheet 106 sealing the suction port 102 formed at the center of the upper surface 101 of the liquid inner container 100 so that the suction tube 6 is inserted into the liquid inner container 100 through the suction port 102.

When the tubular wall portion 14 of the lid member 4 is fitted to the liquid inner container 100 to such an extent that the distal end portion 3 of the tubular wall portion 14 is brought into abutment against the upper end portion 15 of the support frame portion 10 provided to the support member 2, with the positioning means 8 formed of the distal end portion 3 of the tubular wall portion 14 of the lid member 4, the upper end portion 15 of the support frame portion 10 provided to the support member 2, and the upper surface 11 of the pedestal 12, the distal end 6*a* of the suction tube 6 of the discharge pump 7 inserted into the liquid inner container 100 is positioned in the pyramid shape of the bottom portion 103 of the liquid inner container 100. In the first example, the distal end 6*a* of the suction tube 6 is positioned at the deepest portion Din the pyramid shape of the bottom portion 103 of the liquid inner container 100 (see FIG. 9).

When the discharge pump 7 is operated from this state, the liquid inside the liquid inner container 100 is sucked through the suction tube 6 and discharged from the discharge nozzle 17. The liquid inside the liquid inner container 100 is sucked through the suction tube 6 and reduced in amount, and then is collected into the pyramid shape of the bottom portion 103 of the liquid inner container 100. The liquid collected into the pyramid shape of the bottom portion 103 is sucked from the distal end 6*a* of the suction tube 6 located in the pyramid shape of the bottom portion 103. Accordingly, the liquid that remains inside the liquid inner container 100 after the discharge can be minimized in amount.

Figure 10:
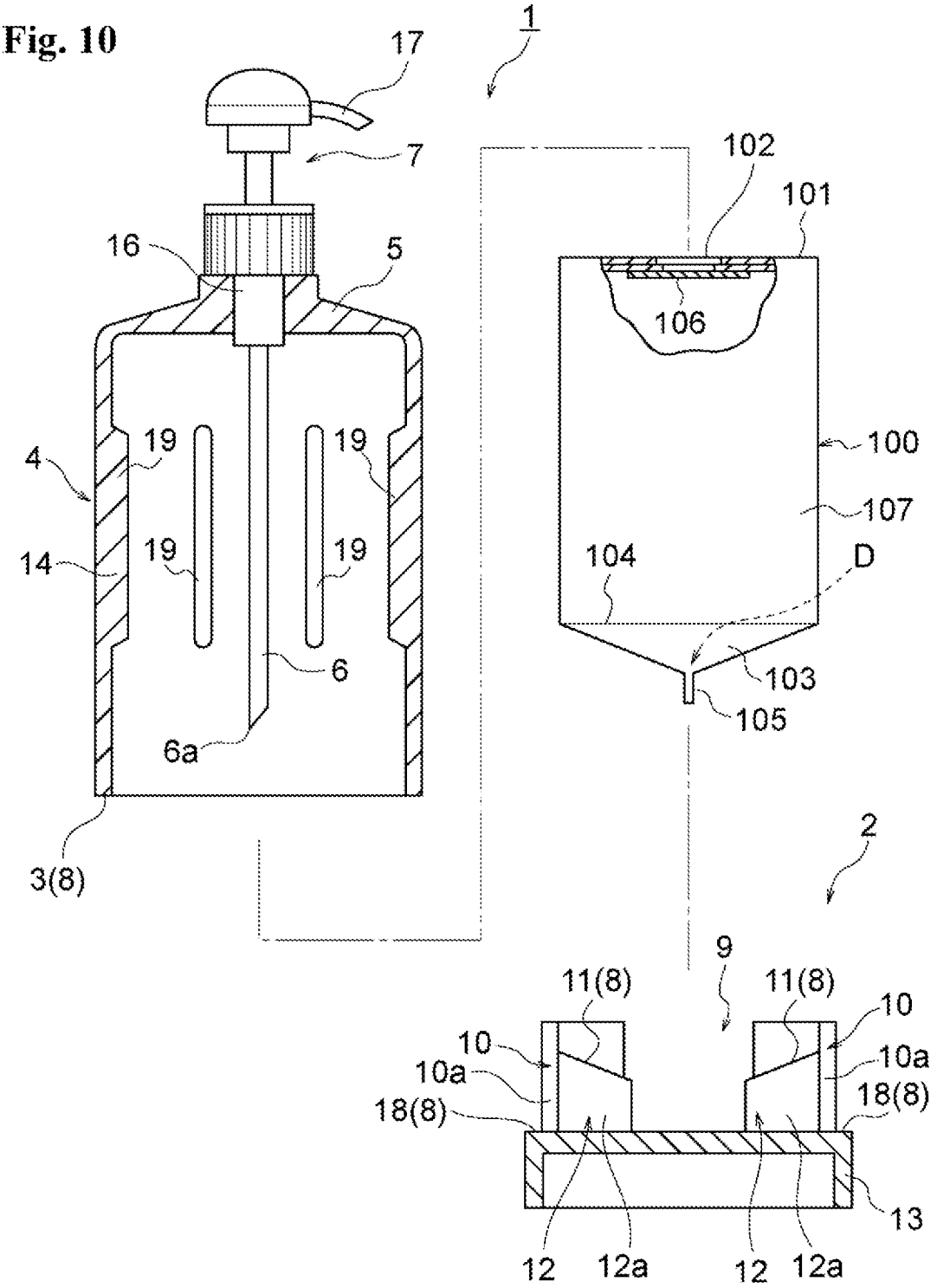
FIG. 10 is an exploded sectional view for illustrating a second example of the refillable container according to the embodiment of the present invention.
Figure 11:
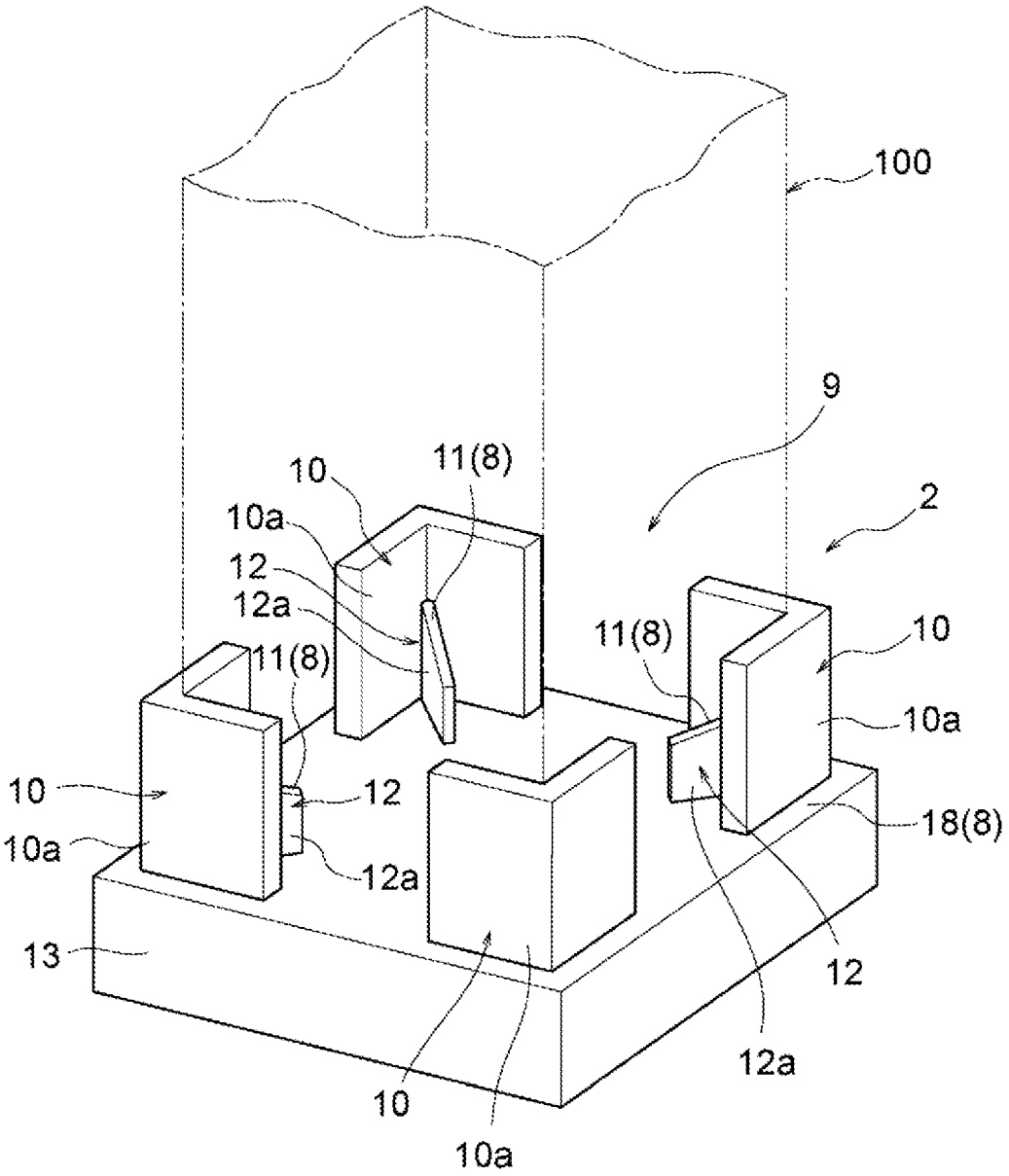
FIG. 11 is an enlarged perspective view for illustrating the support member in the refillable container illustrated in FIG. 10.
Figure 12:
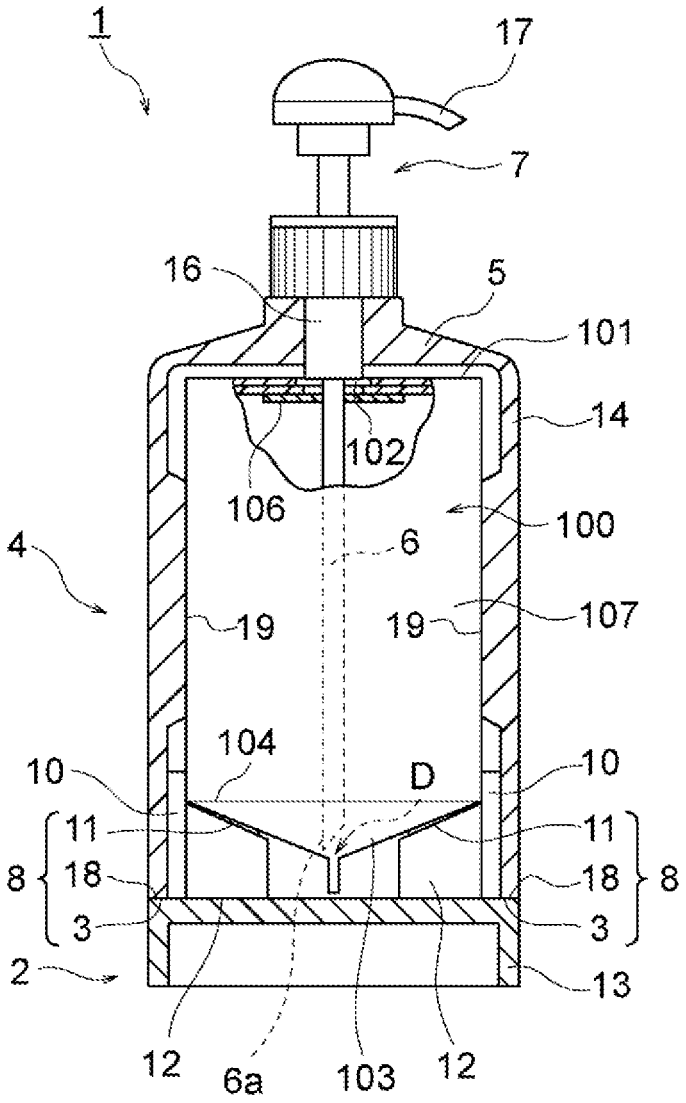
FIG. 12 is an explanatory view for illustrating a state in which the distal end portion of the lid member fitted to the outer periphery of the liquid inner container supported by the support member in the refillable container illustrated in FIG. 10 is locked to the support member.

FIG. 10 to FIG. 12 are views for illustrating a second example of the refillable container according to the embodiment of the present invention. FIG. 10 is an exploded sectional view for illustrating the refillable container of the second example. FIG. 11 is an enlarged perspective view for illustrating the support member in the refillable container illustrated in FIG. 10. FIG. 12 is an explanatory view for illustrating a state in which the distal end portion of the lid member fitted to the outer periphery of the liquid inner container supported by the support member is locked to the support member in the refillable container illustrated in FIG. 10.

The refillable container 1 of the second example is not different from the refillable container 1 of the first example in a basic configuration, and the same configurations as those of the first example are denoted with the same reference symbols for description.

The second example and the first example are different from each other mainly in a configuration of the positioning means 8.

In the second example, as illustrated in FIG. 11, similarly to the first example, the support member 2 includes the support frame portion 10 and the pedestal 12. The support frame portion 10 has the accommodation opening 9 at the upper portion, and is configured to accommodate the bottom portion 103 of the liquid inner container 100 to support the liquid inner container 100 in the vertical direction. The pedestal 12 is provided in the support frame portion 10 so as to protrude from the inner wall of the support frame portion 10 toward the center, and is configured to bring the outer peripheral edge 104 of the bottom portion 103 of the liquid inner container 100 accommodated in the support frame portion 10. In the second example, a locking step portion 18 capable of being locked to the distal end portion 3 of the lid member 4 is formed on an outer surface side of the support frame portion 10.

Further, the support frame portion 10 has a configuration in which the plurality of support frame pieces 10*a* are provided upright on the upper surface of the support base 13 and arranged at intervals along the outer surface of the liquid inner container 100. In the second example, the outer periphery of the support base 13 protrudes toward the outer surface side of the support frame portion 10, and the protruding portion serves as the locking step portion 18.

Further, the tubular wall portion 14 of the lid member 4 can be fitted, together with the liquid inner container 100, to the outer periphery of the support frame portion 10 of the support member 2 supporting the liquid inner container 100. When the tubular wall portion 14 is fitted from above to the outer periphery of the liquid inner container 100 and is further fitted to the outer periphery of the support frame portion 10 of the support member 2, the distal end portion 3 can be locked to the locking step portion 18 formed on the outer surface side of the support frame portion 10.

The distal end portion 3 of the tubular wall portion 14 of the lid member 4, the locking step portion 18 formed on the outer surface side of the support frame portion 10 provided to the support member 2, and the upper surface 11 of the pedestal 12 form the positioning means 8 for positioning the position of the liquid inner container 100 supported by the support member 2 in the vertical direction such that, when the tubular wall portion 14 of the lid member 4 is fitted from above to the liquid inner container 100 supported by the support member 2, the distal end 6*a* of the suction tube 6 is located in the pyramid shape of the bottom portion 103 of the liquid inner container 100.

Further, in the second example, holding portions 19 configured to hold the liquid inner container 100 by being brought into contact with the outer surface of the body 107 of the liquid inner container 100 when fitted to the outer periphery of the liquid inner container 100 are formed on the inner surface of the tubular wall portion 14 of the lid member 4. The contact between the holding portions 19 and the outer surface of the body 107 of the liquid inner container 100 is achieved with pressure that generates a friction force to such an extent that the liquid inner container 100 in which the content has been exhausted does not fall even when the opening portion of the tubular wall portion 14 of the lid member is oriented downwardly. The holding portions 19 are not particularly limited as long as the holding portions 19 are capable of holding the liquid inner container 100 in contact therewith. In the second example, the holding portions 19 are each formed of a rib.

The discharge of the liquid from the liquid inner container 100 with use of the refillable container 1 of the second example thus configured is performed as follows.

First, similarly to the first example, the bottom portion 103 of the liquid inner container 100 containing the liquid inside thereof is accommodated in the support frame portion 10 provided to the support member 2, and the outer peripheral edge 104 of the bottom portion 103 is brought into abutment against the upper surface 11 of the pedestal 12 provided in the support frame portion 10 so that the outer peripheral edge 104 is supported.

Next, the tubular wall portion 14 of the lid member 4 is fitted from above to the outer periphery of the liquid inner container 100 supported by the support member 2. The tubular wall portion 14 is further fitted to the outer periphery of the support frame portion 10 of the support member 2. When the tubular wall portion 14 is fitted to such an extent that the distal end portion 3 is brought into abutment against the locking step portion 18 formed on the outer surface side of the support frame portion 10, the positioning means 8 formed of the distal end portion 3 of the tubular wall portion 14 of the lid member 4, the locking step portion 18 formed on the outer surface side of the support frame portion 10 provided to the support member 2, and the upper surface 11 of the pedestal 12 position the distal end 6*a* of the suction tube 6 of the discharge pump 7 inserted into the liquid inner container 100 to the deepest portion D in the pyramid shape of the bottom portion 103 of the liquid inner container 100 (see FIG. 12).

When the discharge pump 7 is operated from this state, the liquid inside the liquid inner container 100 is sucked through the suction tube 6 and discharged from the discharge nozzle 17.

Further, in the second example, the holding portions 19 configured to hold the liquid inner container 100 by being brought into contact with the outer surface of the body 107 of the liquid inner container 100 when fitted to the outer periphery of the liquid inner container 100 are formed on the inner surface of the tubular wall portion 14 of the lid member 4. Therefore, when the tubular wall portion 14 of the lid member 4 is fitted from above to the outer periphery of the liquid inner container 100, the suction tube 6 of the discharge pump 7 inserted into the liquid inner container 100 is reliably inserted toward the deepest portion D in the pyramid shape of the bottom portion 103 of the liquid inner container 100. Accordingly, the distal end 6*a* of the suction tube 6 of the discharge pump 7 can be reliably allowed to reach the inside of the pyramid shape of the bottom portion 103 of the liquid inner container 100.

Other configurations and effects are the same as those of the first example. Thus, the first example is incorporated, and description thereof is omitted.

Figure 13:
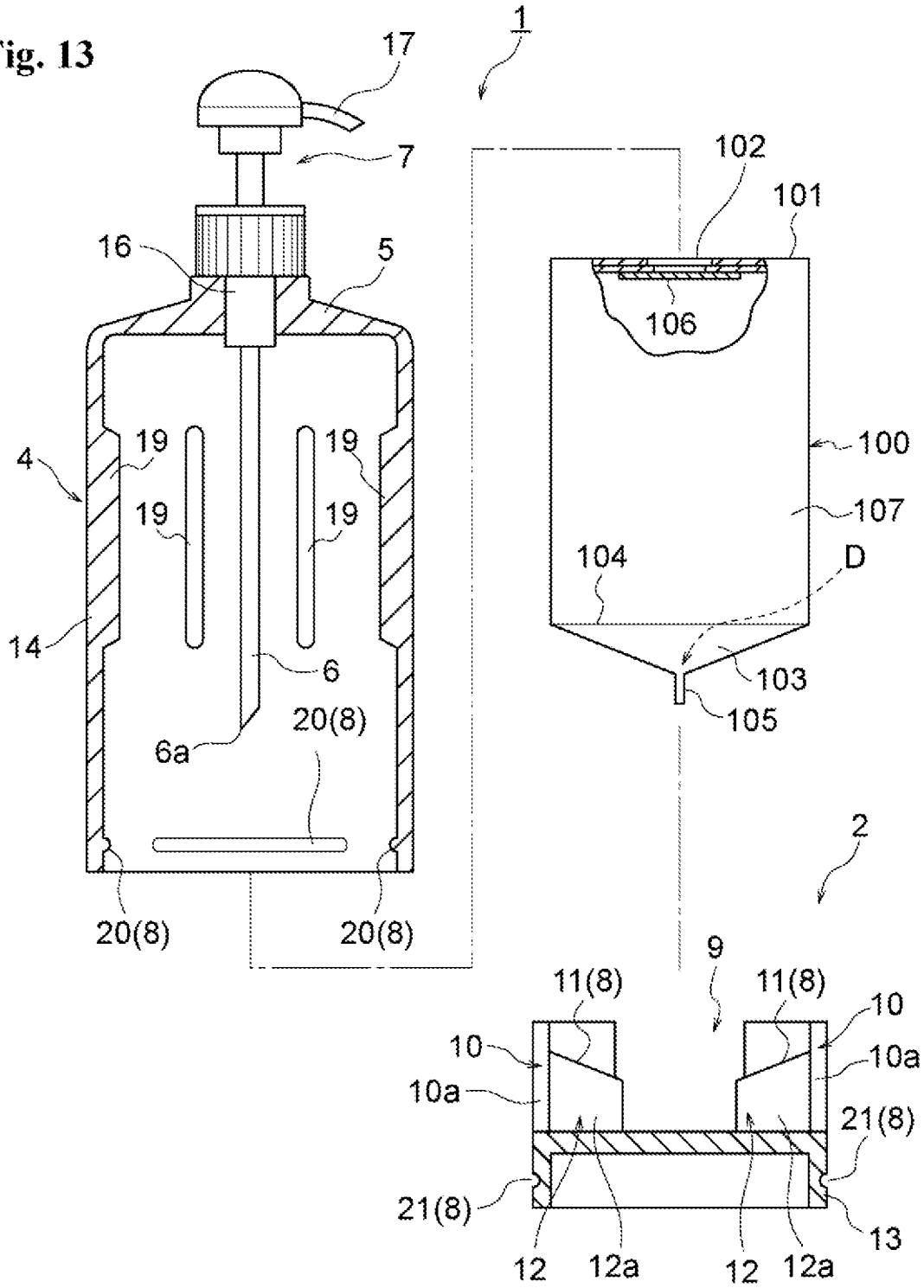
FIG. 13 is an exploded sectional view for illustrating a third example of the refillable container according to the embodiment of the present invention.
Figure 14:
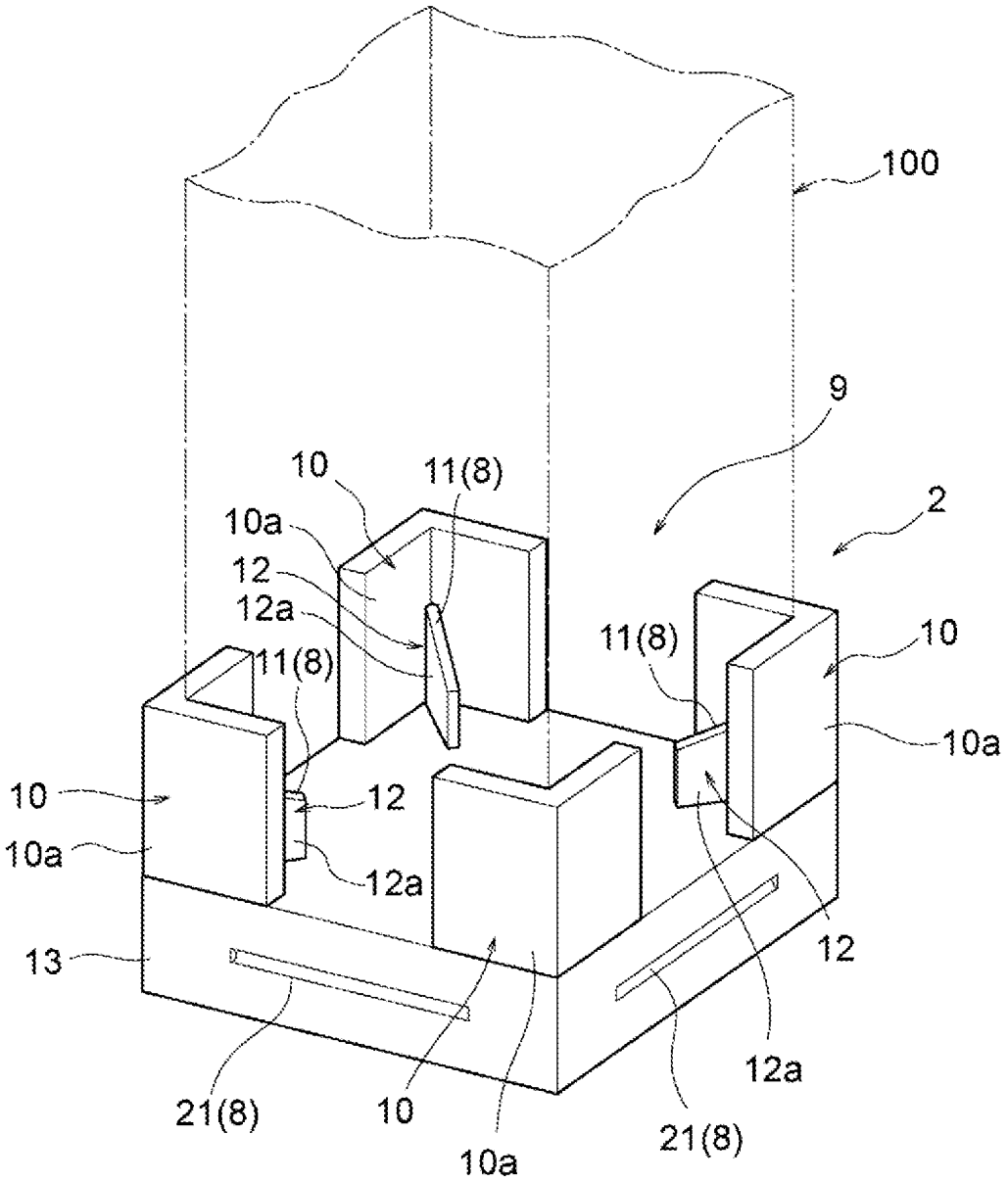
FIG. 14 is an enlarged perspective view for illustrating the support member in the refillable container illustrated in FIG. 13.
Figure 15:
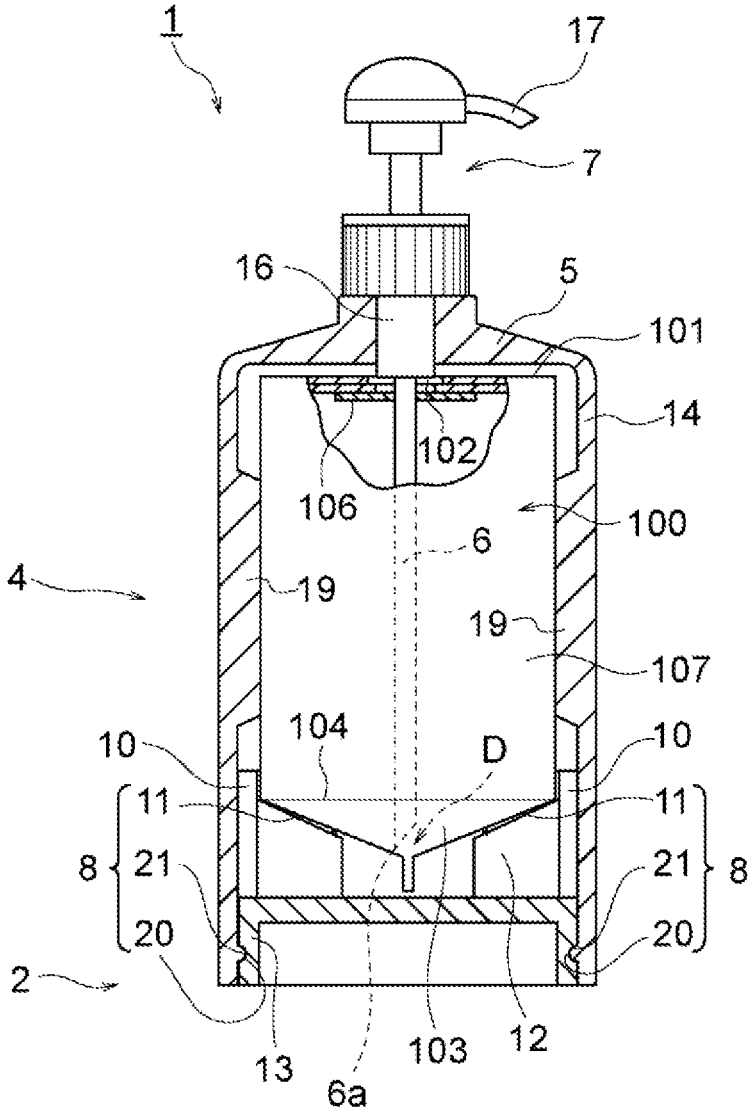
FIG. 15 is an explanatory view for illustrating a state in which the distal end portion of the lid member fitted to the outer periphery of the liquid inner container supported by the support member in the refillable container illustrated in FIG. 13 is locked to the support member.

FIG. 13 to FIG. 15 are views for illustrating a third example of the refillable container according to the embodiment of the present invention. FIG. 13 is an exploded sectional view for illustrating the refillable container of the third example. FIG. 14 is an enlarged perspective view for illustrating the support member in the refillable container illustrated in FIG. 13. FIG. 15 is an explanatory view for illustrating a state in which the distal end portion of the lid member fitted to the outer periphery of the liquid inner container supported by the support member is locked to the support member in the refillable container illustrated in FIG. 13.

The refillable container 1 of the third example is not different from the refillable container 1 of the first example in a basic configuration, and the same configurations as those of the first example are denoted with the same reference symbols for description.

The third example and the first example are different from each other mainly in configurations of the lid member 4 and the positioning means 8.

In the third example, the lid member 4 is made of an elastically deformable material, and the tubular wall portion 14 can be fitted, together with the liquid inner container 100, to the outer periphery of the support base 13 having the upper surface on which the support frame portion 10 of the support member 2 supporting the liquid inner container 100 is provided upright.

Further, protrusions 20 are formed on an inner side surface of the tubular wall portion 14 of the lid member 4 on the distal end side. Further, recesses 21 are formed in an outer side surface of the support base 13. When the tubular wall portion 14 of the lid member 4 is fitted, the protrusions 20 formed on the inner side surface of the tubular wall portion 14 on the distal end side can be engaged with and removed from the recesses 21.

The protrusions 20 formed on the inner side surface of the tubular wall portion 14 of the lid member 4 on the distal end side and the recesses 21 formed in the outer side surface of the support base 13 form the positioning means 8 for positioning the position of the liquid inner container 100 supported by the support member 2 in the vertical direction such that, when the tubular wall portion 14 of the lid member 4 is fitted from above to the liquid inner container 100 supported by the support member 2, the distal end 6*a* of the suction tube 6 is located in the pyramid shape of the bottom portion 103 of the liquid inner container 100.

Further, in the third example, similarly to the second example, the holding portions 19 configured to hold the liquid inner container 100 by being brought into contact with the outer surface of the body 107 of the liquid inner container 100 when fitted to the outer periphery of the liquid inner container 100 are formed on the inner surface of the tubular wall portion 14 of the lid member 4.

The discharge of the liquid from the liquid inner container 100 with use of the refillable container 1 of the third example thus configured is performed as follows.

First, similarly to the first example and the second example, the bottom portion 103 of the liquid inner container 100 containing the liquid inside thereof is accommodated in the support frame portion 10 provided to the support member 2, and the outer peripheral edge 104 of the bottom portion 103 is brought into abutment against the upper surface 11 of the pedestal 12 provided in the support frame portion 10 so that the outer peripheral edge 104 is supported.

Next, the tubular wall portion 14 of the lid member 4 is fitted from above to the outer periphery of the liquid inner container 100 supported by the support member 2. The tubular wall portion 14 is further fitted to the outer periphery of the support base 13 of the support member 2. At this time, the protrusions 20 formed on the inner side surface of the tubular wall portion 14 on the distal end side are elastically deformed through pressing on the outer peripheral surface of the support member 2, thereby enabling fitting of the tubular wall portion 14 to the outer periphery of the support base 13.

When the protrusions 20 formed on the inner side surface of the tubular wall portion 14 on the distal end side reaches the recesses 21 formed on the outer side surface of the support base 13, the elastically deformed protrusions 20 restore and engage with the recesses 21 formed on the outer side surface of the support base 13.

Thus, when the tubular wall portion 14 is fitted to the outer side surfaces of the support base 13 to the extent that the protrusions 20 are engaged with the recesses 21, the positioning means 8 formed of the protrusion 20 and the recess 21 positions the distal end 6*a* of the suction tube 6 of the discharge pump 7 inserted into the liquid inner container 100 at the deepest portion Din the pyramid shape of the bottom portion 103 of the liquid inner container 100 (see FIG. 15).

When the discharge pump 7 is operated from this state, the liquid inside the liquid inner container 100 is sucked through the suction tube 6 and discharged from the discharge nozzle 17.

Other configurations and effects are the same as those of the first example. Thus, the first example is incorporated, and description thereof is omitted.

In the first example, the support frame portion 10 provided to the support member 2 has a configuration in which the plurality of support frame pieces 10*a* are provided upright on the upper surface of the support base 13 and arranged at intervals along the outer surface of the liquid inner container 100. However, the support frame portion 10 may have a cylindrical shape.

Further, it is only required that the liquid inner container 100 at least include the suction port 102 at the center of the upper surface 101 and have the bottom portion 103 formed into the pyramid shape having the deepest portion D at the center.

In the first example, the liquid inner container 100 is made of a paper material. However, the material of the liquid inner container 100 is not limited to the paper material, and the liquid inner container 100 may be made of a resin material. Further, the shape of the body 107 is not limited to the substantially square cylindrical shape, and may be a circular cylindrical shape.

Figure 16:
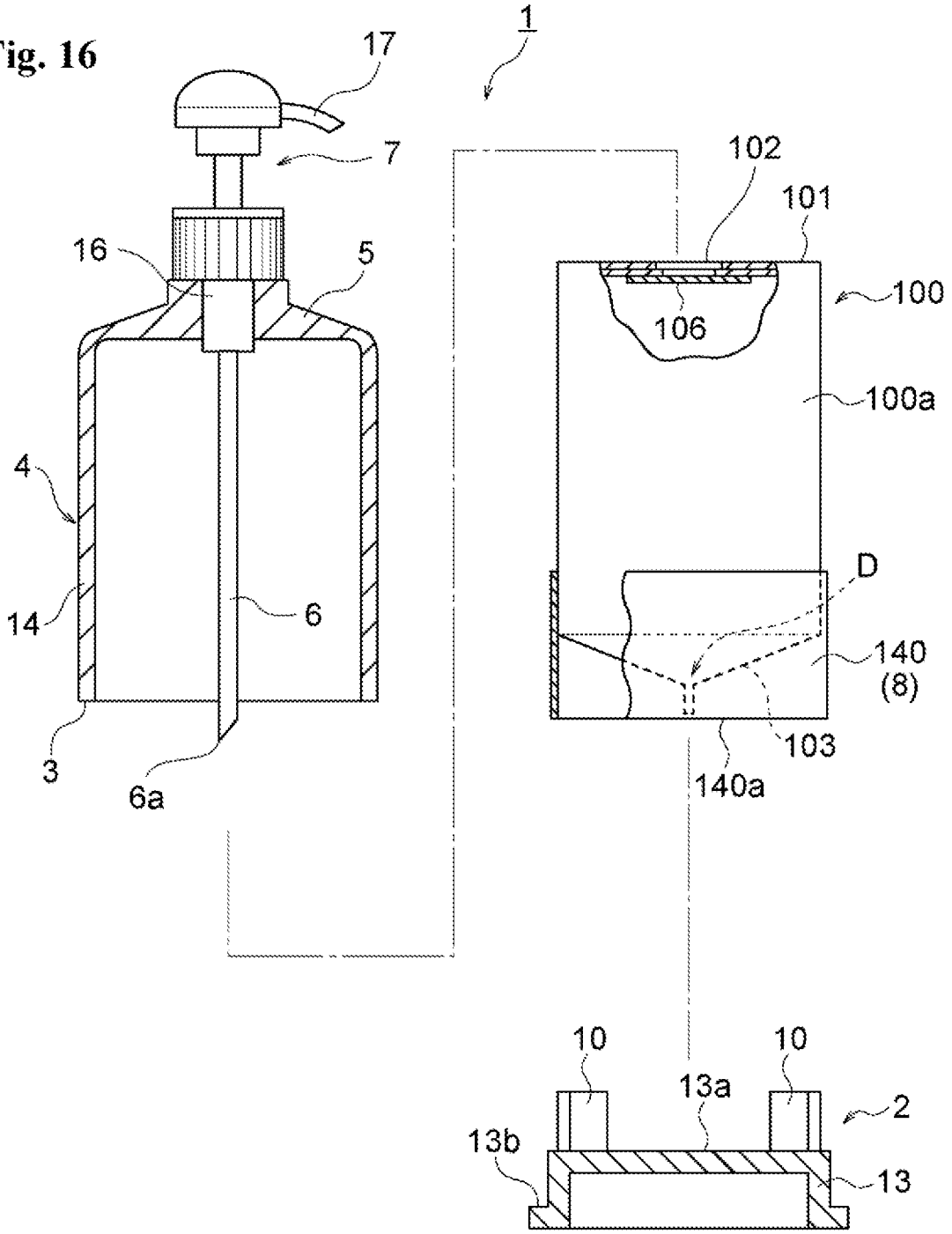
FIG. 16 is an exploded sectional view for illustrating a fourth example of the refillable container according to the embodiment of the present invention.
Figure 17:
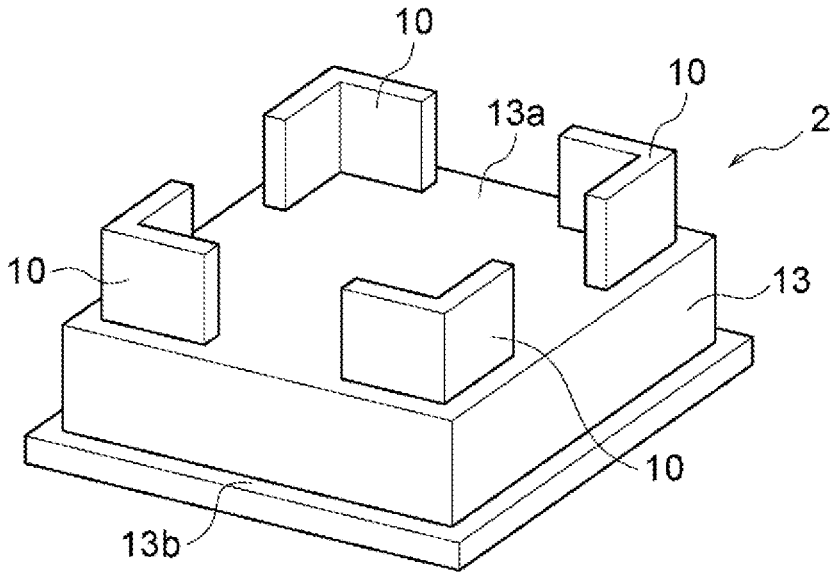
FIG. 17 is a perspective view for illustrating the support member in the refillable container illustrated in FIG. 16.
Figure 18:
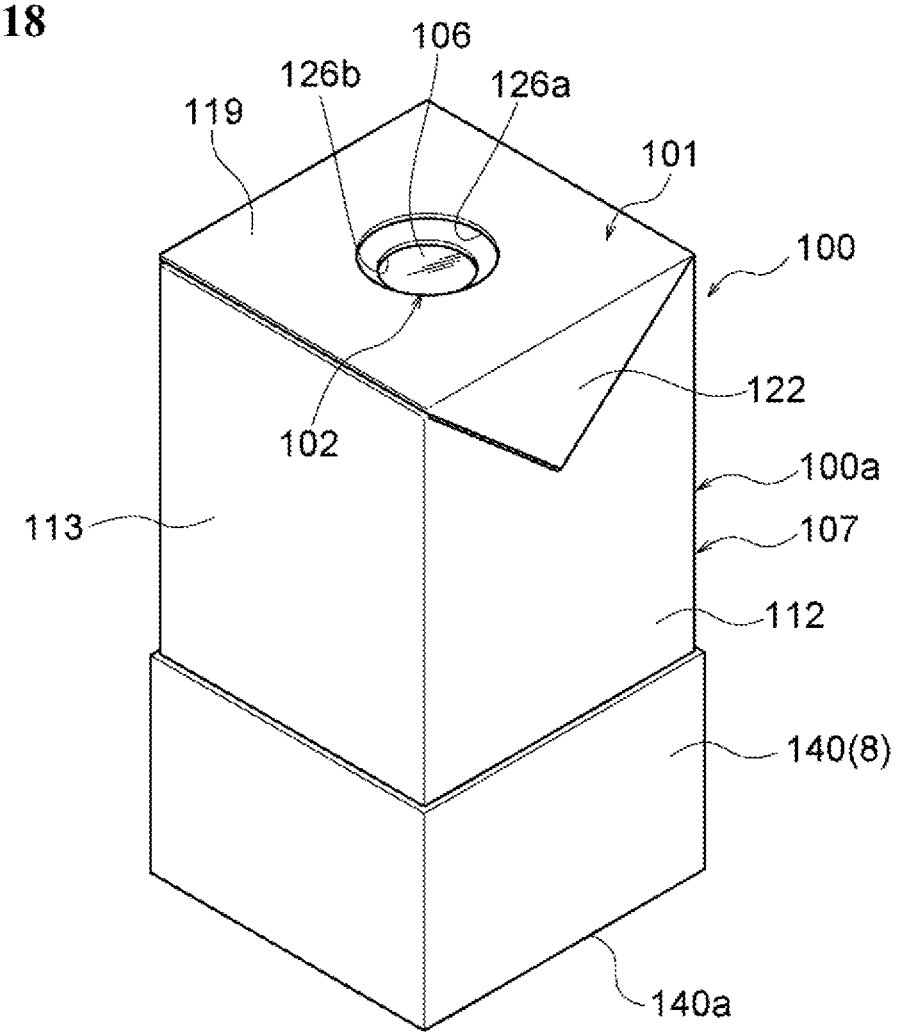
FIG. 18 is a perspective view for illustrating the liquid inner container in the refillable container illustrated in FIG. 16.
Figure 19:
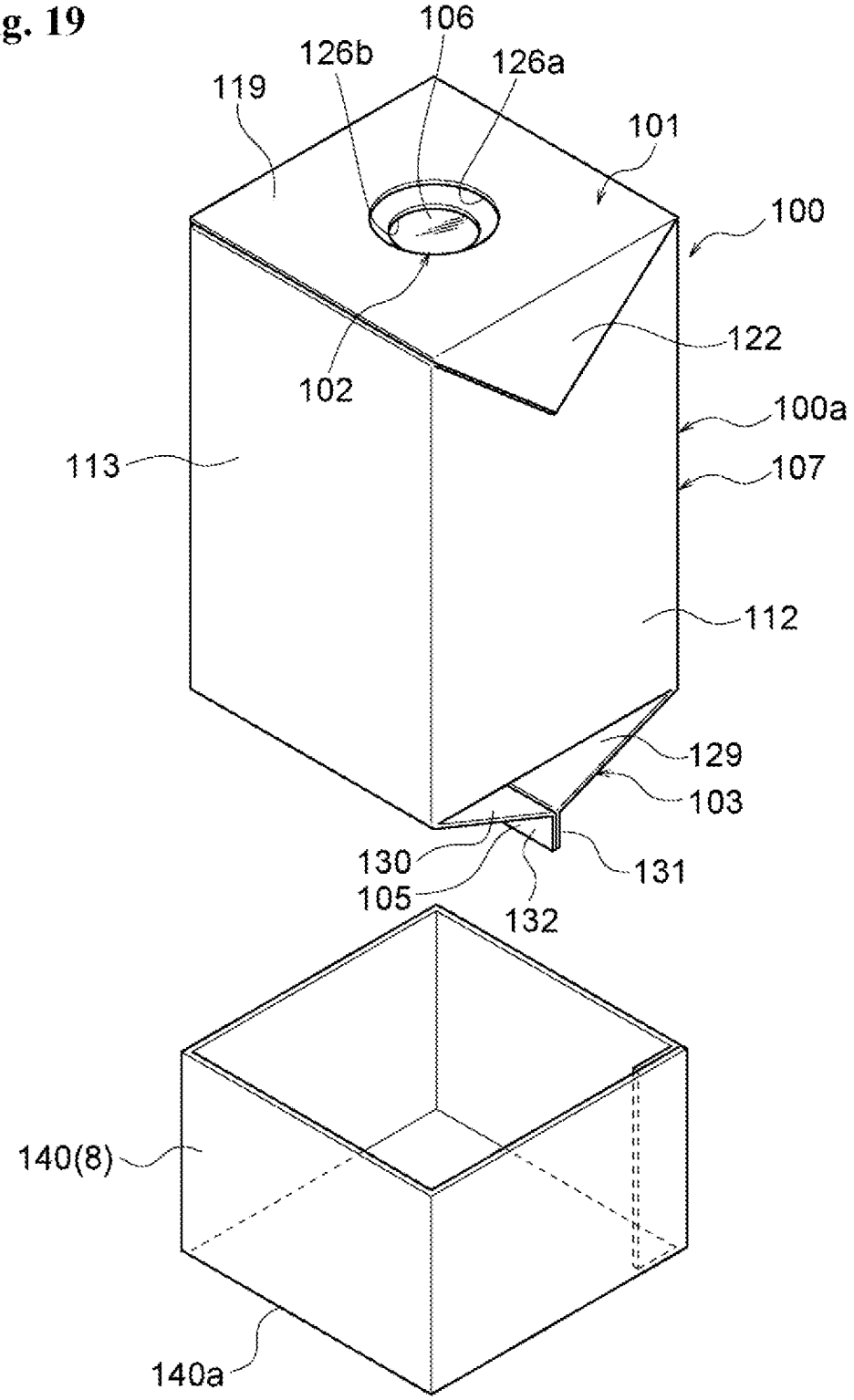
FIG. 19 is an explanatory view for illustrating a configuration in which a skirt portion is provided at a lower portion of a liquid inner container main body.
Figure 20:
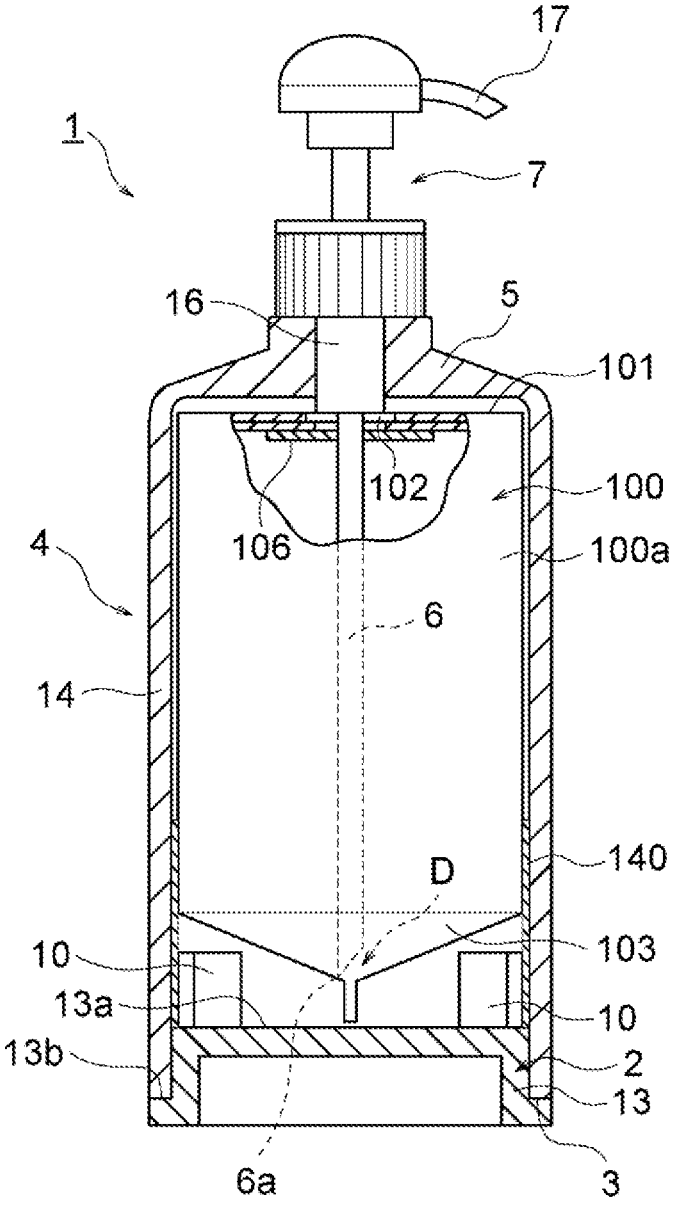
FIG. 20 is an explanatory view for illustrating a state in which the distal end portion of the lid member fitted to the outer periphery of the liquid inner container supported by the support member in the refillable container illustrated in FIG. 16 is locked to the support member.

FIG. 16 to FIG. 20 are views for illustrating a fourth example of the refillable container according to the embodiment of the present invention. FIG. 16 is an exploded sectional view for illustrating the refillable container of the fourth example. FIG. 17 is a perspective view for illustrating the support member in the refillable container illustrated in FIG. 16. FIG. 18 is a perspective view for illustrating the liquid inner container in the refillable container illustrated in FIG. 16. FIG. 19 is an explanatory view for illustrating a configuration in which a skirt portion is provided at a lower portion of the liquid inner container main body. FIG. 20 is an explanatory view for illustrating a state in which the distal end portion of the lid member fitted to the outer periphery of the liquid inner container supported by the support member is locked to the support member in the refillable container illustrated in FIG. 16.

The refillable container 1 of the fourth example is not different from the refillable container 1 of the first example in a basic configuration, and the same configurations as those of the first example are denoted with the same reference symbols for description.

The fourth example and the first example are different from each other mainly in a configuration of the positioning means 8.

In the fourth example, a skirt portion 140 is provided at a lower portion of the liquid inner container main body 100*a*. The skirt portion 140 covers the bottom portion 103 formed into the pyramid shape and enables the liquid inner container 100 to stand.

The skirt portion 140 is set to such a length that, at a position at which the distal end portion 3 of the lid member 4 is fitted to the outer periphery of the liquid inner container 100 supported by the support member 2, the position of the liquid inner container 100 supported by the support member 2 in the vertical direction is determined such that the distal end 6*a* of the suction tube 6 of the discharge pump 7 inserted through the suction port 102 is located in the pyramid shape of the bottom portion 103. Accordingly, the skirt portion 140 forms the positioning means 8.

In the fourth example, the shape of the support member 2 is not particularly limited as long as the support member 2 can hold the bottom portion 103 of the liquid inner container 100 to support the liquid inner container 100 in a standing state.

The support member 2 of the fourth example is formed of the support base 13 and the support frame portion 10. The support base 13 has an upper surface which serves as a support surface 13*a* configured to receive a lower-portion-side end portion of the liquid inner container 100, that is, a lower-portion-side end portion of the skirt portion 140 provided at the lower portion of the liquid inner container main body 100*a*. The support frame portion 10 is provided on the support surface 13*a* of the support base 13, and enters the inside of the skirt portion 140 provided at the lower portion of the liquid inner container main body 100*a* and abut against four corners of the skirt portion 140, to thereby support the liquid inner container 100 on the support surface 13*a* in a state of allowing the liquid inner container 100 to stand in the vertical direction (see FIG. 17).

The support base 13 is formed into a shape conforming to an outer shape of the liquid inner container 100. In the fourth example, the outer shape of the support base 13 has substantially the same dimension and shape as the outer shape of the body 107 of the liquid inner container 100. Further, a locking step portion 13*b* with which the distal end portion 3 of the lid member 4 can be engaged is formed on the outer periphery of the support base 13.

Next, description is made of the lid member 4. The lid member 4 of the fourth example includes the tubular wall portion 14. The tubular wall portion 14 is fitted from above to the outer periphery of the liquid inner container 100 supported by the support member 2 to accommodate the liquid inner container 100. In the fourth example, the tubular wall portion 14 is fitted to the outer periphery of the liquid inner container 100 supported by the support member 2 and is fitted also to the outer periphery of the support base 13 of the support member 2 so that the distal end portion 3 is locked to the locking step portion 13*b* formed on the outer periphery of the support base 13.

In the fourth example, the skirt portion 140 is formed into a cylindrical shape, and is fitted to the outer periphery of the lower portion of the liquid inner container main body 100*a* so as to completely cover the bottom portion 103, thereby being fixed to the liquid inner container main body 100*a* (see FIG. 18 and FIG. 19).

In the fourth example, the skirt portion 140 is made of a paper material with a resin layer laminated on at least one side thereof, and is fixed to the outer periphery of the liquid inner container main body 100*a* by hot melt.

A lower edge 140*a* of the skirt portion 140 fitted to the lower portion of the liquid inner container main body 100*a* in such a manner is formed at an angle which enables the liquid inner container 100 to stand in a vertical state.

Further, in the fourth example, the skirt portion 140 is set to such a length that, at the position at which the distal end portion 3 of the lid member 4 fitted to the outer periphery of the liquid inner container 100 supported by the support member 2 is locked to the locking step portion 13*b* of the support base 13 on the support member 2, the position of the liquid inner container 100 supported by the support member 2 in the vertical direction is determined such that the distal end 6*a* of the suction tube 6 of the discharge pump 7 inserted through the suction port 102 is located in the pyramid shape of the bottom portion 103. In the fourth example, the skirt portion 140 is set to such a length that the distal end 6*a* of the suction tube 6 of the discharge pump 7 is positioned so as to be located at the deepest portion D in the pyramid shape of the bottom portion 103.

In the fourth example, the body of the liquid inner container main body 100*a* is formed into the quadrangular cylindrical shape. However, the shape of the body may be a polygonal, circular, or oval cylindrical shape.

According to the refillable container 1 of the fourth example thus configured, the liquid inner container 100 includes, at the lower portion of the liquid inner container main body 100*a* thereof, the skirt portion 140 which covers the bottom portion 103 formed into the pyramid shape with the deepest portion D at the center thereof and enables the liquid inner container 100 to stand. Thus, for example, with the skirt portion 140 brought into abutment against a placement surface of a display shelf, the liquid inner container 100 can be displayed in a vertically standing state with the bottom portion 103 oriented downwardly.

Further, the bottom portion 103 is covered with the skirt portion 140, and hence the bottom portion 103 is not brought into abutment against the placement surface when the liquid inner container 100 is placed on the placement surface. Accordingly, the distal end part of the bottom portion 103 formed into the pyramid shape is less liable to be deformed.

Further, in the fourth example, the skirt portion 140 is set to such a length that, at the position at which the distal end portion 3 of the lid member 4 fitted to the outer periphery of the liquid inner container 100 supported by the support member 2 is locked to the support member 2, the position of the liquid inner container 100 supported by the support member 2 in the vertical direction is determined such that the distal end 6*a* of the suction tube 6 of the discharge pump 7 inserted through the suction port 102 is located in the pyramid shape of the bottom portion 103. Accordingly, when the lid member 4 is fitted to the outer periphery of the liquid inner container 100 supported by the support member 2, and the distal end portion 3 of the lid member 4 is locked to the support member 2, the distal end 6*a* of the suction tube 6 of the discharge pump 7 inserted into the liquid inner container 100 is located in the pyramid shape of the bottom portion 103 (see FIG. 20).

With this, the liquid inside the liquid inner container 100 is sucked out by the discharge pump 7 and reduced in amount, and the liquid collected into the pyramid shape of the bottom portion 103 is sucked through the distal end 6*a* of the suction tube 6 of the discharge pump 7 located in the pyramid shape of the bottom portion 103 and is discharged.

Therefore, the liquid that remains inside the liquid inner container 100 after discharge can be reduced in amount in amount.

In the fourth example, the length is set such that the distal end 6*a* of the suction tube 6 of the discharge pump 7 is positioned so as to be located at the deepest portion D in the pyramid shape of the bottom portion 103. Accordingly, the liquid that remains inside the liquid inner container 100 after discharge can be minimized in amount.

Further, in the fourth example, the support member 2 configured to support the liquid inner container 100 is formed of the support base 13 and the support frame portion 10. The support base 13 has the upper surface which serves as the support surface 13*a* configured to receive the lower-portion-side end portion of the liquid inner container 100, that is, the lower-portion-side end portion of the skirt portion 140 provided at the lower portion of the liquid inner container main body 100*a*. The support frame portion 10 is provided on the support surface 13*a* of the support base 13, and enters the inside of the skirt portion 140 provided at the lower portion of the liquid inner container main body 100*a* and abut against the four corners of the skirt portion 140, to thereby support the liquid inner container 100 on the support surface 13*a* in the state of allowing the liquid inner container 100 to stand in the vertical direction. Accordingly, the liquid inner container 100 can be stably supported in the state of being allowed to stand in the vertical direction by the support frame portion 10.

Other configurations are the same as those of the first example. Thus, the first example is incorporated, and description thereof is omitted.

REFERENCE SIGNS LIST

1 refillable container
2 support member
3 distal end portion
4 lid member
5 top surface portion
6 suction tube
6*a* distal end
7 discharge pump
8 positioning means
9 accommodation opening
10 support frame portion
10*a* support frame piece
10A protruding portion
11 upper surface
12 pedestal
12*a* pedestal piece
13 support base
13*a* support surface
13*b* locking step portion
14 tubular wall portion
15 upper end portion
16 tubular cylinder portion
17 discharge nozzle
18 locking step portion
19 holding portion
20 protrusion
21 recess
100 liquid inner container
100*a* liquid inner container main body
101 upper surface
102 suction port
103 bottom portion
104 outer peripheral edge
105 seal portion
106 sealing sheet
107 body
108, 109, 110 body longitudinal folding line
111, 112, 113, 114 body panel
115 seal longitudinal folding line
116 longitudinal seal panel
117, 118 top horizontal folding line
119, 120 upper-surface forming panel
121 sealing panel
122, 123 side panel
124, 125 top horizontal folding line
126*a*, 126*b* hole
127, 128 bottom horizontal folding line
129, 130 gable roof-shaped bottom portion forming panel
131, 132 outer sealing panel
133, 134 bottom horizontal folding line
135, 136 gable wall-shaped bottom portion forming panel
137, 138 inner sealing panel
140 skirt portion
140*a* lower edge
D deepest portion

The invention claimed is:

1. A refillable container, comprising:

an inner container, which has a suction port at a center of an upper surface and a bottom portion with a pyramid shape having a deepest portion at a center of the bottom portion, and is configured to contain a liquid inside and be replaced when the liquid has been exhausted;

a support member configured to hold the bottom portion of the inner container so as to support the inner container in a standing state;

a lid member, which is fitted from above to an outer periphery of the inner container supported by the support member so as to accommodate the inner container, and has a distal end portion configured to be locked to the support member;

a discharge pump, which is on a top surface portion of the lid member, and is configured to discharge the liquid to an outside by sucking the liquid through a suction tube, and through the suction port of the inner container, the suction tube of the discharge pump being inserted into the suction port of the inner container when the lid member is fitted from above to the outer periphery of the inner container; and positioning means for positioning, at a position at which the distal end portion of the lid member is locked to the support member, a position of the inner container in a vertical direction such that: (i) a distal end of the suction tube of the discharge pump is located in the pyramid shape of the bottom portion of the inner container; and (ii) a seal portion at the bottom portion of the inner container is prevented from coming into contact with the support member.

2. The refillable container according to claim 1, wherein the support member includes:

a support frame portion configured to accommodate the bottom portion of the inner container so as to support the inner container in the vertical direction; and a pedestal, which protrudes from an inner wall of the support frame portion toward a center, and is configured to bring an outer peripheral edge of the bottom portion of the inner container into abutment against an upper surface of the pedestal, wherein the support frame portion has an upper end portion which is configured to be locked to the distal end portion of the lid member, and wherein the positioning means is defined by the distal end portion of the lid member, the upper end portion of the support frame portion, and the upper surface of the pedestal.

3. The refillable container according to claim 1, wherein the support member includes:

a support frame portion configured to accommodate the bottom portion of the inner container so as to support the inner container in the vertical direction; and a pedestal, which protrudes from an inner wall of the support frame portion toward a center, and is configured to bring an outer peripheral edge of the bottom portion of the inner container into abutment against an upper surface thereof, wherein the lid member is configured to fit, together with the inner container, to an outer periphery of the support frame portion, wherein the support frame portion has, on an outer surface side thereof, a locking step portion configured to lock the distal end portion of the lid member, and wherein the distal end portion of the lid member, the locking step portion of the support frame portion, and the upper surface of the pedestal define the positioning means.

4. The refillable container according to claim 1, wherein the support member includes:

a support frame portion configured to accommodate the bottom portion of the inner container so as to support the inner container in the vertical direction;

a pedestal, which protrudes from an inner wall of the support frame portion toward a center, and is configured to bring an outer peripheral edge of the bottom portion of the inner container into abutment against an upper surface of the pedestal; and a support base configured to allow the support frame portion to be upright on an upper surface of the support base, wherein the lid member is made of an elastically deformable material, and is configured to fit, together with the support frame portion and the inner container, to an outer periphery of the support base, wherein the lid member has a protrusion on an inner side surface thereof on a distal end side, and the support base has a recess in an outer side surface thereof so as to allow the protrusion of the lid member to be engaged therewith and removed therefrom, and wherein the protrusion of the lid member and the recess of the support base define the positioning means.

5. The refillable container according to claim 2, wherein the upper surface of the pedestal is inclined downwardly toward the center, and wherein an inclination angle of the upper surface of the pedestal with respect to a horizontal direction is equal to or larger than an inclination angle of the bottom portion of the inner container.

6. The refillable container according to claim 2, wherein the pedestal includes a plurality of pedestal pieces arranged in the support frame portion in a standing state at intervals in a circumferential direction, and respective upper sides of the plurality of pedestal pieces define the upper surface of the pedestal.

7. The refillable container according to claim 2, wherein, in the support frame portion, a height of a protruding portion protruding upwardly from the pedestal is: (i) equal to or larger than 5% of a body height of the inner container; and (ii) smaller than the body height of the inner container.

8. The refillable container according to claim 1, wherein the inner container includes a skirt portion at a lower portion of a main body of the inner container, and configured to cover the bottom portion of the inner container and enable the inner container to stand.

9. The refillable container according to claim 8, wherein the skirt portion defines at least part of the positioning means.

10. The refillable container according to claim 3, wherein the upper surface of the pedestal is inclined downwardly toward the center, and wherein an inclination angle of the upper surface of the pedestal with respect to a horizontal direction is equal to or larger than an inclination angle of the bottom portion of the inner container.

11. The refillable container according to claim 4, wherein the upper surface of the pedestal is inclined downwardly toward the center, and wherein an inclination angle of the upper surface of the pedestal with respect to a horizontal direction is equal to or larger than an inclination angle of the bottom portion of the inner container.

12. The refillable container according to claim 3, wherein the pedestal includes a plurality of pedestal pieces arranged in the support frame portion in a standing state at intervals in a circumferential direction, and respective upper sides of the plurality of pedestal pieces define the upper surface of the pedestal.

13. The refillable container according to claim 4, wherein the pedestal includes a plurality of pedestal pieces arranged in the support frame portion in a standing state at intervals in a circumferential direction, and respective upper sides of the plurality of pedestal pieces define the upper surface of the pedestal.

14. The refillable container according to claim 5, wherein the pedestal includes a plurality of pedestal pieces arranged in the support frame portion in a standing state at intervals in a circumferential direction, and respective upper sides of the plurality of pedestal pieces define the upper surface of the pedestal.

15. The refillable container according to claim 3, wherein, in the support frame portion, a height of a protruding portion protruding upwardly from the pedestal is: (i) equal to or larger than 5% of a body height of the inner container; and (ii) smaller than the body height of the inner container.

16. The refillable container according to claim 4, wherein, in the support frame portion, a height of a protruding portion protruding upwardly from the pedestal is: (i) equal to or larger than 5% of a body height of the inner container; and (ii) smaller than the body height of the inner container.

17. The refillable container according to claim 5, wherein, in the support frame portion, a height of a protruding portion protruding upwardly from the pedestal is: (i) equal to or larger than 5% of a body height of the inner container; and (ii) smaller than the body height of the inner container.

18. The refillable container according to claim 6, wherein, in the support frame portion, a height of a protruding portion protruding upwardly from the pedestal is: (i) equal to or larger than 5% of a body height of the inner container; and (ii) smaller than the body height of the inner container.

* * * * *